US012662226B2

(12) United States Patent
Buchanan et al.

(10) Patent No.: US 12,662,226 B2
(45) Date of Patent: Jun. 23, 2026

(54) REMOTE TROLLING MOTOR STEERING CONTROL

(71) Applicant: Navico, Inc., Tulsa, OK (US)

(72) Inventors: Spencer Buchanan, Auckland (NZ); Paul Robert Bailey, Auckland (NZ)

(73) Assignee: Navico, Inc., Tulsa, OK (US)

( * ) Notice: Subject to any disclaimer, the term of this patent is extended or adjusted under 35 U.S.C. 154(b) by 425 days.

(21) Appl. No.: 18/322,814

(22) Filed: May 24, 2023

(65) Prior Publication Data

US 2023/0294809 A1 Sep. 21, 2023

Related U.S. Application Data

(63) Continuation-in-part of application No. 17/558,735, filed on Dec. 22, 2021.

(51) Int. Cl.

| | |
|---|---|
| ***B63H 21/00*** | (2006.01) |
| ***B63B 79/40*** | (2020.01) |
| ***B63H 20/12*** | (2006.01) |
| ***B63H 21/21*** | (2006.01) |

(52) U.S. Cl.

CPC ..... *B63H 21/213* (2013.01); *B63B 79/40* (2020.01); *B63H 20/12* (2013.01); *B63B 2213/02* (2013.01); *B63H 2021/216* (2013.01)

(58) Field of Classification Search

CPC ..... B63H 21/213; B63H 79/40; B63H 20/12; B63H 2213/02; B63H 2021/216

USPC ..... 701/22

See application file for complete search history.

(56) References Cited

U.S. PATENT DOCUMENTS

| | | | |
|---|---|---|---|
| 4,737,940 | A | 4/1988 | Arringotn |
| 4,995,010 | A | 2/1991 | Knight |
| 5,525,081 | A | 6/1996 | Mardesich et al. |
| 5,807,150 | A | 9/1998 | Minter, Sr. |
| 6,054,831 | A | 4/2000 | Moore et al. |
| 6,254,441 | B1 | 7/2001 | Knight et al. |
| 6,325,685 | B1 | 12/2001 | Knight et al. |

(Continued)

FOREIGN PATENT DOCUMENTS

| | | | |
|---|---|---|---|
| AU | 2014224154 | B2 | 4/2015 |
| AU | 2021107112 | A4 | 12/2021 |

(Continued)

*Primary Examiner* — Mahmoud S Ismail

(74) *Attorney, Agent, or Firm* — Nelson Mullins Riley & Scarborough LLP

(57) ABSTRACT

A method of operating a handheld device for controlling a watercraft motor is provided. The method comprises determining whether the handheld device is operating in an anchor mode or a heading hold mode; receiving movement data when the joystick is in a non-neutral position that includes a direction of movement; generating steering command(s), with a steering command of the steering command(s) being based on the movement data; causing motor rotation based on the steering command; detecting the joystick shifting to the neutral position, with the watercraft being at a location when the joystick shifts to the neutral position; when in the anchor mode, causing the motor to cease operation proximate to the location after the joystick has shifted to the neutral position; and, when in the heading hold mode, causing the motor to continue operating so that the watercraft travels in the new heading direction after the joystick shifts.

22 Claims, 21 Drawing Sheets

(56) References Cited

U.S. PATENT DOCUMENTS 6,369,542 B1 4/2002 Knight
D461,480 S 8/2002 Knight et al.
6,447,347 B1 9/2002 Steinhauser
6,507,164 B1 1/2003 Healey et al.
6,511,354 B1 1/2003 Gonring et al.
6,524,144 B2 2/2003 Pasley
6,620,006 B2 9/2003 Suganuma et al.
6,652,331 B2 11/2003 Healey
6,661,742 B2 12/2003 Hansen
6,678,589 B2 1/2004 Robertson et al.
6,870,794 B2 3/2005 Healey
6,902,446 B1 6/2005 Healey
6,919,704 B1 7/2005 Healey
6,995,527 B2 2/2006 DePasqua
7,004,804 B2 2/2006 Bernloehr et al.
7,048,600 B1 5/2006 Broussard
7,127,333 B2 10/2006 Arvidsson
7,150,662 B1 12/2006 Janitz
7,195,526 B2 3/2007 Bernloehr et al.
7,268,703 B1 9/2007 Kabel et al.
7,303,595 B1 12/2007 Janitz
7,538,511 B2 5/2009 Samek
D594,034 S 6/2009 Bernloehr et al.
7,722,417 B2 5/2010 Bernloehr et al.
7,972,188 B2 7/2011 Bernloehr et al.
8,082,100 B2 12/2011 Grace et al.
8,106,617 B1 1/2012 Holley
8,296,001 B1 10/2012 Kabel et al.
8,305,844 B2 11/2012 DePasqua
8,313,379 B2 11/2012 Ikeda et al.
8,326,472 B2 12/2012 Igarashi et al.
8,510,028 B2 8/2013 Grace et al.
8,515,660 B2 8/2013 Grace et al.
8,515,661 B2 8/2013 Grace et al.
8,523,620 B2 9/2013 Hopkins
8,527,192 B2 9/2013 Grace et al.
8,543,269 B1 9/2013 Wood et al.
8,543,324 B2 9/2013 Grace et al.
8,641,525 B2 2/2014 Burgess et al.
8,645,012 B2 2/2014 Salmon et al.
8,684,328 B2 4/2014 Mynster
8,761,976 B2 6/2014 Salmon
8,798,847 B2 8/2014 Isaac
8,814,129 B2 8/2014 Todd et al.
8,831,868 B2 9/2014 Grace et al.
8,879,359 B2 11/2014 DePasqua
8,888,065 B2 11/2014 Logan
8,894,453 B2 11/2014 Case
8,926,382 B2 1/2015 Van Der et al.
8,936,498 B1 1/2015 Lee
8,974,260 B1 3/2015 Davidson
9,043,073 B2 5/2015 Ricci
9,086,278 B2 7/2015 Carnevali
9,127,707 B1 9/2015 Huntley
9,132,900 B2 9/2015 Salmon et al.
9,160,210 B2 10/2015 Perry
9,162,743 B1 10/2015 Grace et al.
9,260,173 B2 2/2016 Case
9,266,589 B2 2/2016 Grace et al.
9,278,745 B2 3/2016 Kooi, Jr. et al.
9,290,256 B1 3/2016 Wireman et al.
9,296,455 B2 3/2016 Bernloehr et al.
9,394,040 B2 7/2016 Grace et al.
9,405,445 B2 8/2016 Carnevali
9,409,637 B1 8/2016 Arditi
9,415,849 B2 8/2016 Jobs et al.
9,423,259 B2 8/2016 Kabel et al.
9,440,716 B1 9/2016 Arditi
9,446,831 B2 9/2016 Grace et al.
9,459,350 B2 10/2016 Betts et al.
9,463,860 B2 10/2016 Grace et al.
9,505,477 B2 11/2016 Grace et al.
9,522,721 B2 12/2016 Grace et al.
9,569,954 B2 2/2017 Ganz et al.
9,598,157 B2 3/2017 Arditi
9,623,946 B2 4/2017 Delise, Sr.
9,676,462 B2 6/2017 Bernloehr et al.
9,682,759 B1 6/2017 Huntley
9,690,295 B1 * 6/2017 Abellera ..... G06F 17/00
9,708,042 B2 7/2017 Grace et al.
9,731,800 B2 8/2017 Arditi
9,738,358 B2 8/2017 Arditi
9,738,364 B2 8/2017 Abney
9,758,222 B2 9/2017 Grace et al.
9,764,808 B2 9/2017 Arditi
9,834,295 B2 12/2017 Cooper et al.
9,878,766 B2 1/2018 Woodruff
9,878,769 B2 1/2018 Kinoshita et al.
9,909,891 B2 3/2018 Langford-Wood
9,937,985 B2 4/2018 Arditi
9,944,365 B2 4/2018 Grace et al.
9,944,375 B1 4/2018 Martin et al.
9,963,214 B2 5/2018 Watanabe et al.
9,988,134 B1 6/2018 Gable et al.
10,000,268 B1 6/2018 Poirier et al.
10,053,200 B1 * 8/2018 Koetsier ..... B63H 20/106
10,082,788 B1 9/2018 Dengel et al.
10,107,908 B2 10/2018 Betts et al.
10,137,972 B2 11/2018 Kawasaki et al.
10,150,551 B2 12/2018 Steward et al.
10,179,633 B2 1/2019 Carnevali
10,266,242 B2 4/2019 Arditi
10,281,576 B2 5/2019 DePasqua
10,281,928 B2 5/2019 Behling et al.
10,290,124 B2 5/2019 Steward
10,295,999 B2 5/2019 Jobs et al.
10,322,780 B2 6/2019 Grace et al.
10,351,218 B2 7/2019 Arditi
10,370,076 B2 8/2019 Wireman
10,377,458 B1 8/2019 Mcginley
10,460,484 B2 10/2019 Hovland et al.
10,464,649 B1 11/2019 Wood
10,464,653 B2 11/2019 Anderson et al.
10,488,204 B2 11/2019 Rivers
10,507,895 B2 12/2019 Grace et al.
10,526,060 B2 1/2020 Arditi
10,618,621 B1 4/2020 Rott et al.
10,633,072 B1 4/2020 Arbuckle et al.
10,723,423 B2 7/2020 Eyal et al.
10,745,096 B2 8/2020 Clark
10,766,589 B1 9/2020 Ito
10,775,177 B2 9/2020 Rivers
10,809,725 B2 10/2020 Combs
10,845,812 B2 11/2020 Ward et al.
D905,757 S 12/2020 Domke et al.
10,913,524 B1 2/2021 Wald et al.
10,921,802 B2 2/2021 Bertrand et al.
10,926,855 B2 2/2021 Derginer et al.
10,953,973 B2 3/2021 Hayashi et al.
10,981,634 B2 4/2021 Arditi
11,059,555 B2 7/2021 Ahlgren
11,059,556 B2 7/2021 Ahlgren
11,072,402 B2 7/2021 Arditi
11,104,409 B2 8/2021 Pietola et al.
11,104,410 B2 8/2021 Kester et al.
11,173,996 B2 11/2021 Salmon et al.
11,367,425 B2 6/2022 Antao et al.
2001/0020603 A1 9/2001 Moorehead et al.
2002/0044500 A1 4/2002 Hansen
2003/0191562 A1 10/2003 Robertson et al.
2003/0203684 A1 10/2003 Healey
2005/0255761 A1 11/2005 Bernloehr et al.
2006/0089794 A1 4/2006 DePasqua
2006/0116031 A1 6/2006 Bernloehr et al.
2007/0089660 A1 * 4/2007 Bradley ..... B63H 21/22 114/144 A
2009/0037040 A1 2/2009 Salmon et al.
2009/0043436 A1 2/2009 Igarashi et al.
2009/0163090 A1 6/2009 Heromin
2009/0227158 A1 9/2009 Bernloehr et al.
2010/0116967 A1 5/2010 Todd et al.
2012/0014220 A1 1/2012 DePasqua
2012/0015566 A1 1/2012 Salmon
2012/0204467 A1 8/2012 Palmer et al.

(56) References Cited

U.S. PATENT DOCUMENTS

| | | | | |
|---|---|---|---|---|
| 2012/0232719 | A1 | 9/2012 | Salmon et al. | |
| 2013/0044569 | A1 | 2/2013 | DePasqua | |
| 2013/0110329 | A1 | 5/2013 | Kinoshita et al. | |
| 2013/0215719 | A1 | 8/2013 | Betts et al. | |
| 2014/0203162 | A1 | 7/2014 | Logan | |
| 2014/0249698 | A1* | 9/2014 | Salmon | G05D 1/0206 701/2 |
| 2014/0269164 | A1 | 9/2014 | Betts et al. | |
| 2014/0277851 | A1 | 9/2014 | Grace et al. | |
| 2015/0016130 | A1 | 1/2015 | Davis et al. | |
| 2015/0063059 | A1 | 3/2015 | DePasqua | |
| 2015/0063060 | A1 | 3/2015 | DePasqua | |
| 2015/0346729 | A1 | 12/2015 | Grace et al. | |
| 2015/0346730 | A1 | 12/2015 | Stephens et al. | |
| 2016/0016651 | A1 | 1/2016 | Anderson et al. | |
| 2017/0158297 | A1 | 6/2017 | Sampson | |
| 2017/0160738 | A1 | 6/2017 | Ganz et al. | |
| 2018/0129213 | A1 | 5/2018 | Pelin et al. | |
| 2019/0137993 | A1* | 5/2019 | Bertrand | B63H 25/02 |
| 2019/0138014 | A1 | 5/2019 | Väänänen et al. | |
| 2019/0138015 | A1 | 5/2019 | Pietola et al. | |
| 2019/0154450 | A1 | 5/2019 | Wada | |
| 2019/0219692 | A1 | 7/2019 | DePasqua | |
| 2020/0017177 | A1 | 1/2020 | Eyal et al. | |
| 2020/0018601 | A1 | 1/2020 | Yamabayashi et al. | |
| 2020/0049507 | A1 | 2/2020 | Clark et al. | |
| 2020/0062365 | A1 | 2/2020 | Anderson et al. | |
| 2020/0269962 | A1 | 8/2020 | Gai et al. | |
| 2020/0272152 | A1* | 8/2020 | Combs | G05D 1/0206 |
| 2020/0398963 | A1 | 12/2020 | Miyashita | |
| 2021/0009239 | A1 | 1/2021 | Eyal et al. | |
| 2021/0139126 | A1 | 5/2021 | Derginer et al. | |
| 2021/0163114 | A1 | 6/2021 | Bondesson et al. | |
| 2021/0229781 | A1 | 7/2021 | Arditi | |
| 2021/0291951 | A1 | 9/2021 | Gai | |
| 2021/0371074 | A1* | 12/2021 | Lammers-Meis | B63H 5/125 |
| 2022/0009604 | A1 | 1/2022 | Arditi | |
| 2022/0017203 | A1 | 1/2022 | Pedersen | |
| 2022/0063772 | A1 | 3/2022 | Ambler | |
| 2022/0073180 | A1 | 3/2022 | Salmon et al. | |
| 2022/0212770 | A1 | 7/2022 | Cosentino et al. | |
| 2022/0234702 | A1 | 7/2022 | Maddox et al. | |
| 2023/0139789 | A1* | 5/2023 | Ikegaya | B63H 21/21 440/1 |
| 2023/0356809 | A1* | 11/2023 | Hagen | B63B 32/60 |

FOREIGN PATENT DOCUMENTS

| | | | |
|---|---|---|---|
| CA | 2359223 | C | 10/2006 |
| CA | 2962361 | A1 | 4/2015 |
| CA | 2891245 | A1 | 12/2015 |
| CA | 2897182 | A1 | 1/2016 |
| CA | 2897540 | A1 | 1/2016 |
| CA | 2641186 | C | 5/2017 |
| CA | 2895863 | C | 10/2017 |
| CA | 2952593 | C | 6/2018 |
| CA | 3108305 | A1 | 2/2020 |
| CA | 2982936 | C | 11/2020 |
| CN | 207956019 | U | 10/2018 |
| CN | 213892861 | U | 8/2021 |
| CN | 114842635 | A | 8/2022 |
| EP | 0024813 | B1 | 5/1983 |
| EP | 1448436 | B1 | 4/2010 |
| EP | 2586696 | A1 | 5/2013 |
| EP | 1891461 | B1 | 5/2014 |
| EP | 2952994 | A1 | 12/2015 |
| EP | 3176068 | B1 | 6/2017 |
| EP | 2974242 | B1 | 7/2018 |
| EP | 3406516 | B1 | 9/2019 |
| EP | 3594621 | A1 | 1/2020 |
| EP | 3604110 | A1 | 2/2020 |
| EP | 3633318 | A1 | 4/2020 |
| EP | 3653489 | A1 | 5/2020 |
| EP | 3283364 | B1 | 7/2020 |
| EP | 3699714 | A2 | 8/2020 |
| EP | 3707072 | A1 | 9/2020 |
| EP | 3716015 | A1 | 9/2020 |
| EP | 3728021 | A1 | 10/2020 |
| EP | 3821419 | A1 | 5/2021 |
| EP | 3830806 | A1 | 6/2021 |
| EP | 3914983 | A1 | 12/2021 |
| EP | 4034460 | A1 | 8/2022 |
| EP | 4045394 | A1 | 8/2022 |
| JP | 2002-154483 | A | 5/2002 |
| JP | 4706032 | B2 | 6/2011 |
| JP | 4709975 | B2 | 6/2011 |
| JP | 2013103526 | A | 5/2013 |
| JP | 2013106082 | A | 5/2013 |
| JP | 5827872 | B2 | 12/2015 |
| JP | 5836765 | B2 | 12/2015 |
| JP | 2018-99902 | A | 6/2018 |
| JP | 2018-125012 | A | 8/2018 |
| JP | 6372046 | B2 | 8/2018 |
| JP | 6513677 | B2 | 5/2019 |
| JP | 6769611 | B2 | 10/2020 |
| JP | 2021-501724 | A | 1/2021 |
| WO | WO 1995/028682 | A1 | 10/1995 |
| WO | WO 03/042036 | A1 | 5/2003 |
| WO | WO 2006/062416 | A1 | 6/2006 |
| WO | WO 2006/112416 | A1 | 10/2006 |
| WO | WO 2013126761 | A1 | 8/2013 |
| WO | WO 2014/052531 | A1 | 4/2014 |
| WO | WO 2014/144471 | A1 | 9/2014 |
| WO | WO 2014/152628 | A1 | 9/2014 |
| WO | WO 2015/048479 | A1 | 4/2015 |
| WO | WO 2016/017358 | A1 | 2/2016 |
| WO | WO 2016/168025 | A1 | 10/2016 |
| WO | WO 2017/146796 | A1 | 8/2017 |
| WO | WO 2019/082044 | A1 | 5/2019 |
| WO | WO 2019/086762 | A1 | 5/2019 |
| WO | WO 2019/125177 | A1 | 6/2019 |
| WO | WO 2020/007471 | A1 | 1/2020 |
| WO | WO 2020/016881 | A1 | 1/2020 |
| WO | WO 2020/069750 | A1 | 4/2020 |
| WO | WO 2020/070312 | A1 | 4/2020 |
| WO | WO 2020/098898 | A1 | 5/2020 |
| WO | WO 2020/193756 | A1 | 10/2020 |
| WO | WO 2021/061612 | A1 | 4/2021 |
| WO | WO 2021/074483 | A1 | 4/2021 |
| WO | WO 2021/173441 | A1 | 9/2021 |
| WO | WO 2022/159867 | A1 | 7/2022 |

* cited by examiner

REMOTE TROLLING MOTOR STEERING CONTROL

CROSS-REFERENCE TO RELATED APPLICATION(S)

This application claims priority to and is a continuation-in-part application of U.S. application Ser. No. 17/558,735, entitled "Device for Steering a Trolling Motor and Method of the Same", filed Dec. 22, 2021, the contents of which is incorporated by reference herein in its entirety.

FIELD OF THE INVENTION

Embodiments of the present invention relate generally to steering of motors such as trolling motors, and more particularly, to steering a motor with a remote handheld device.

BACKGROUND OF THE INVENTION

Trolling motor assemblies are often used during fishing or other marine activities. The trolling motor system attaches to the watercraft and propels the watercraft along a body of water. While trolling motor assemblies may be utilized as the main propulsion system of watercraft, trolling motor assemblies are often utilized to provide secondary propulsion or precision maneuvering that can be ideal for fishing activities. Typically, trolling motor assemblies include a small gas or electric trolling motor for providing thrust and a steering mechanism for changing the direction of the generated thrust.

Traditional button remotes are limited to control in an X-axis and in a Y-axis, making it difficult to cause the watercraft to shift to locations that do not fall on either of these axes. Reaching locations that do not fall on one of these axes often requires the user to engage in trial and error, and the location is typically reached only after the user has pressed buttons to shift the watercraft several times. For example, if a user is attempting to shift to a location that is located 22 feet away in an X-direction and 17 feet away in a Y-direction, the user will have significant difficulty in reaching the location, and there will be a high risk of over shooting or undershooting. These difficulties are further compounded by the fact that traditional button remotes often cause the watercraft to shift at only limited preset amounts.

Additionally, traditional button remotes currently have limited safety restrictions to prevent sudden changes in direction or thrust generated. For example, where a user inadvertently presses a button on the traditional button remote to cause significant rotation of the watercraft at a high speed, traditional button remotes often have no override feature to limit the amount of rotation, creating significant safety concerns for those onboard.

BRIEF SUMMARY OF THE INVENTION

Handheld remote controls generally use a push pad to indicate the desired direction of rotation of a trolling motor. In some devices, when a user engages, a button the trolling motor rotates a specific amount in that direction; for example, pressing the right button may cause a trolling motor to rotate to the right by 1 degree, 5 degrees or 10 degrees. However, the user is generally unable to easily determine (e.g., with a quick look) the orientation of the trolling motor with respect to the heading of the watercraft. Therefore, the user must make multiple adjustments to determine the orientation of the trolling motor and rotate the trolling motor to the desired orientation. Further, steering the trolling motor to a desired direction requires a user determination of which way to rotate the trolling motor and then having to continually hold down the appropriate push pad and releasing it at the exact correct time (e.g., to avoid overshoot). This process can be frustrating to a user.

Alternatively, a user may use a foot pedal to steer the trolling motor. The foot pedal may provide an electrical signal based on the position of the foot pedal to electronically steer the trolling motor wherein tilting the back of the foot pedal downward causes the trolling motor to rotate to the left, and tilting the front of the foot pedal downward causes the trolling motor to rotate to the right. However, the foot pedal may include similar limitations to the remote, wherein a user is unable to readily determine the orientation of the trolling motor at a given time. Further, steering the trolling motor to a desired direction requires a user determination of which way to rotate the trolling motor and then having to continually hold down the foot pedal in the proper direction and releasing it at the exact correct time (e.g., to avoid overshoot). This process can be frustrating to a user.

Applicant has developed various systems and methods, as detailed herein to provide a device to steer a trolling motor to a desired orientation with a remote device, without needing to specify a rotation direction and current knowledge of the orientation of the trolling motor.

Some embodiments of the present invention are directed to a device (e.g., a handheld) for use with a trolling motor assembly. The device may be in electrical communication with the trolling motor assembly, such that movement of a joystick from a neutral position causes the trolling motor to rotate directly to a specific direction corresponding to the movement of the joystick. Prior knowledge of the current direction the trolling motor is facing and/or knowing exactly when to stop providing input (such as to not overshoot the direction) is not required for such example embodiments of the invention—providing advantages of prior trolling motor direction steering devices. The device may include various push buttons configured to engage or disengage other features of the trolling motor system, for example, the propeller, a virtual anchor, and/or an autopilot.

Unlike traditional button remotes that are limited to control in an X-axis and in a Y-axis, handheld remote devices include a joystick that allow for more precise control. Accurate and precise control is considered to be a crucial feature when navigating, and the inclusion of the joystick in handheld remote devices offers various potential uses described herein that provide more intuitive, precise, and safe control of a motor. Handheld remote devices are provided that are configured to control the operation of a motor on the watercraft so that the motor is operated in a heading hold mode or an anchor mode, and tapping motions in these modes are configured to cause adjustments in the heading direction in an incremental amount or adjustments in the position of the watercraft by some jog distance.

The handheld remote devices comprise a joystick that can be rotated from a neutral position to a non-neutral position. Based on the position of the joystick, commands are generated to make adjustments at the motor. The amount of rotation of the motor and/or thrust applied at the motor may be dependent on position of the joystick, and movement of the joystick to a non-neutral position may cause a new heading direction to be accomplished for the watercraft. In a heading hold mode, the release of the joystick back to the neutral position may cause the motor to continue operating at the same level of thrust so that the watercraft continues travelling in the new heading direction. In an anchor mode, the release of the joystick back to the neutral position may cause the motor to cease operating proximate to the location where the watercraft is located when the joystick is released. Handheld remote devices may include a plurality of buttons to increase and decrease the speed of the watercraft or the amount of thrust applied at the motor and to change the mode of operation between, for example, the anchor mode and the heading hold mode (although other modes are contemplated and described herein).

In some embodiments, the handheld remote devices may be configured so that, when in the anchor mode, the handheld remote devices cause the watercraft to shift a preset jog distance when a user makes a tapping motion with the joystick. One or more buttons may be provided on the handheld remote devices to adjust the jog distance. The handheld remote devices may also be configured so that, when in the heading hold mode, the handheld remote devices cause rotation of the motor in preset amounts when the user makes a tapping motion with the joystick. One or more buttons may be provided on the handheld remote devices to adjust the preset rotation amounts. The handheld remote device may be configured to cause the watercraft to shift in any jog direction, and the jog directions are not limited to the any specific axes. Thus, users may more efficiently shift the watercraft to the desired position.

Additionally, while traditional button remotes currently have limited safety restrictions to prevent sudden changes in direction or thrust generated, the handheld remote devices provided in various embodiments herein limit the rotational velocity or rotational acceleration of the watercraft to maintain the safety of the watercraft and passengers onboard.

In an example embodiment, a handheld device for controlling operation of a trolling motor of a watercraft is provided. The handheld device includes a housing. The handheld device also includes a joystick attached to the housing and pivotably supported for movement from a neutral position in directions radial to an axis of the joystick, and the movement from the neutral position generates one or more steering commands for the trolling motor. The handheld device also includes a transmitter within the housing and at least one processor communicatively coupled to the transmitter and the joystick. The handheld device also includes a memory including computer program product stored thereon. The computer program product is configured, when executed, to cause the at least one processor to determine that the handheld device is operating in an anchor mode or a heading hold mode. The computer program product is configured, when executed, to cause the at least one processor to receive movement data from the joystick when the joystick is in a non-neutral position, and the movement data includes a direction of movement from the neutral position. The computer program product is configured, when executed, to cause the at least one processor to generate the one or more steering commands, and at least one steering command of the one or more steering commands is based on the movement data. The computer program product is configured, when executed, to cause the at least one processor to cause rotation of the trolling motor based on the steering command to cause the watercraft to travel in a new heading direction when the trolling motor is in the water and when the trolling motor is operating. The computer program product is configured, when executed, to cause the at least one processor to detect the joystick shifting from the non-neutral position back to the neutral position, wherein the watercraft is at a location when the joystick shifts to the neutral position. In response thereto, the computer program product is configured to, when executed, cause the at least one processor to cause the trolling motor to cease operation proximate to the location after the joystick has shifted to the neutral position when the handheld device is operating in the anchor mode. Alternatively, the computer program product is configured to, when executed, cause the at least one processor to cause the trolling motor to continue operating so that the watercraft continues to travel in the new heading direction after the joystick has shifted to the neutral position when the handheld device is operating in the heading hold mode.

In an example embodiment, each of the one or more steering commands may have at least one of rotational component or a thrust component, the rotational component of the one or more steering commands may cause rotation of the trolling motor, and the thrust component of the one or more steering commands may cause the generation of thrust at the trolling motor. In some embodiments, when the handheld device is operating in the heading hold mode, the rotational component may be determined based on the position of the joystick, the thrust component may remain at a set value after the joystick has shifted to the neutral position, and the set value may be a non-zero value. Additionally, in some embodiments, at least one of the rotational component or the thrust component may be limited for safety. Furthermore, in some embodiments, the rotational component may be limited for safety. In some embodiments, the rotational component may be determined based on the position of the joystick, a speed of the watercraft, and a direction of the watercraft.

In some embodiments, the joystick may not used to control the amount of thrust generated at the trolling motor.

In some embodiments, the computer program code may be configured to, when executed, cause the at least one processor to detect a tapping action at the joystick when the handheld device is operating in an anchor mode, detect a tapping direction of the joystick during the tapping action, and cause the watercraft to shift for a jog distance and in a jog direction based on the tapping direction. Additionally, in some embodiments, the jog distance may be between one foot and twenty feet. Furthermore, in some embodiments, the handheld device also includes at least one jog distance button, and the computer program code is configured to, when executed, cause the at least one processor to determine that the at least one jog distance button has been activated and to cause an increase or a decrease in the jog distance based on activation of the at least one jog distance button. In some embodiments, the computer program code may be configured to, when executed, cause the at least one processor to detect the joystick being retained in the non-neutral position when the handheld device is operating in an anchor mode. Each of the one or more steering commands may have a rotational component and a thrust component, each of the one or more steering commands may cause at least one of rotation or thrust at the trolling motor, the thrust component of the steering command may be maintained at a set value when the joystick is retained in the non-neutral position, and the set value may be a non-zero value. Also, in some embodiments, the computer program code may be configured to, when executed, cause the at least one processor to detect the joystick being retained in the non-neutral position when the handheld device is operating in an anchor mode, and the thrust component of the steering command may be dependent upon a displacement of the joystick from the neutral position when the joystick is in the activated position.

In some embodiments, the computer program code may be configured to, when executed, cause the at least one processor to determine the position of the joystick when the joystick is in a second non-neutral position when the handheld device is operating in the heading hold mode, with the second non-neutral position being different from the non-neutral position. The computer program code may also be configured to, when executed, cause rotation of the trolling motor based on the position of the joystick when the joystick is in the second non-neutral position, and rotation of the trolling motor may cause the watercraft to travel in a second heading direction when the trolling motor is in the water and the trolling motor is operating.

In some embodiments, the handheld device may also include at least one mode selection button, and the computer program code may be configured, when executed, to cause the at least one processor to determine that the at least one mode selection button has been activated, and to cause the handheld device to change its mode of operation to the anchor mode or the heading hold mode based on activation of the at least one mode selection button. Additionally, the at least one mode selection button may include an anchor button and a heading hold button, the anchor button may be configured to switch to the anchor mode when activated, and the heading hold button may be configured to switch to the heading hold mode when activated.

In some embodiments, the handheld device may also include at least one speed input, and the computer program code may be configured to, when executed, cause the at least one processor to receive an indication that the at least one speed input has been activated and cause the trolling motor to increase or decrease a set value for a thrust component of a steering command based on activation of the at least one speed input. Additionally, in some embodiments, the at least one speed input may include a first speed button and a second speed button, the first speed button may be configured to increase the speed, the second speed button may be configured to decrease the speed, and the computer program code may be configured to, when executed, cause the at least one processor to determine that at least one of the first speed button or the second speed button has been activated and to cause the motor to increase thrust based on activation of the first speed button or to decrease thrust based on activation of the second speed button.

In another example embodiment, a system for controlling the operation a watercraft is provided. The system comprises the watercraft, a housing, and a joystick attached to the housing and pivotably supported for movement from a neutral position in directions radial to an axis of the joystick. The movement from the neutral position generates one or more steering commands for a trolling motor. The system also comprises a transmitter within the housing and at least one processor communicatively coupled to the transmitter and the joystick. The system also includes a memory including computer program product stored thereon. The computer program product is configured, when executed, to cause the at least one processor to determine that the handheld device is operating in an anchor mode or a heading hold mode and to receive movement data from the joystick when the joystick is in a non-neutral position, with the movement data including a direction of movement from the neutral position. The computer program product is also configured, when executed, to cause the at least one processor to generate the one or more steering commands, with at least one steering command of the one or more steering commands being based on the movement data. The computer program product is also configured, when executed, to cause the at least one processor to cause rotation of the trolling motor based on the steering command to cause the watercraft to travel in a new heading direction when the trolling motor is in the water and when the trolling motor is operating. The computer program product is also configured, when executed, to cause the at least one processor to detect the joystick shifting from the non-neutral position back to the neutral position, with the watercraft being at a location when the joystick shifts to the neutral position. In response thereto, the computer program product may also be configured, when executed, to cause the at least one processor to cause trolling motor to cease operation proximate to the location after the joystick has shifted to the neutral position when the handheld device is operating in the anchor mode. Alternatively, the computer program product may be configured, when executed, to cause the at least one processor to cause the trolling motor to continue operating so that the watercraft continues to travel in the new heading direction after the joystick has shifted to the neutral position when the handheld device is operating in the heading hold mode. In some embodiments, the system may also include a GPS sensor, and the at least one processor may be configured to cause a determination of the location using data from the GPS sensor.

In another example embodiment, a method of operating a handheld device for controlling a motor of a watercraft is provided. The method comprises determining that the handheld device is operating in an anchor mode or a heading hold mode; receiving movement data from the joystick when the joystick is in a non-neutral position, with the movement data including a direction of movement from the neutral position; generating one or more steering commands, with at least one steering command of the one or more steering commands being based on the movement data; causing rotation of the motor based on the steering command to cause the watercraft to travel in a new heading direction when the motor is in the water and when the motor is operating; and detecting the joystick shifting from the non-neutral position back to the neutral position, with the watercraft being at a location when the joystick shifts to the neutral position. In response thereto, the method may also comprise causing the motor to cease operation proximate to the location after the joystick has shifted to the neutral position when the handheld device is operating in the anchor mode. Alternatively, the method may comprise causing the motor to continue operating so that the watercraft continues to travel in the new heading direction after the joystick has shifted to the neutral position when the handheld device is operating in the heading hold mode.

In some embodiments, a handheld device for controlling operation of a trolling motor of a watercraft in an anchor mode is provided. The handheld device includes a housing. The handheld device also includes a joystick attached to the housing and pivotably supported for movement from a neutral position in directions radial to an axis of the joystick. The movement from the neutral position generates one or more steering commands for the trolling motor. The handheld device also includes a transmitter within the housing and at least one processor communicatively coupled to the transmitter and the joystick. The handheld device also includes a memory including a computer program product stored thereon. The computer program product is configured, when executed, to cause the at least one processor to determine that the handheld device is operating in the anchor mode and to receive movement data from the joystick when the joystick is in a non-neutral position, with the movement data including a direction of movement from the neutral position. The computer program product is also configured, when executed, to cause the at least one processor to generate the one or more steering commands, with at least one steering command of the one or more steering commands being based on the movement data. The computer program product is also configured, when executed, to cause the at least one processor to cause the watercraft to move using on the one or more steering commands applied at the trolling motor when the trolling motor is in the water and when the trolling motor is operating and to detect the joystick shifting from the non-neutral position back to the neutral position, with the watercraft being at a location when the joystick shifts to the neutral position. The computer program product is also configured, when executed, to cause the at least one processor to cause, in response thereto, the trolling motor to cease operation proximate to the location after the joystick has shifted to the neutral position.

In another example embodiment, a handheld device for controlling operation of a trolling motor of a watercraft in a heading hold mode is provided. The handheld device includes a housing and a joystick attached to the housing and pivotably supported for movement from a neutral position in directions radial to an axis of the joystick. The movement from the neutral position generates one or more steering commands for the trolling motor. The handheld device also includes a transmitter within the housing, at least one processor communicatively coupled to the transmitter and the joystick, and a memory including computer program product stored thereon. The computer program product is configured, when executed, to cause the at least one processor to determine that the handheld device is operating in the heading hold mode and to receive movement data from the joystick when the joystick is in a non-neutral position, with the movement data including a direction of movement from the neutral position. The computer program product is configured, when executed, to cause the at least one processor to generate the one or more steering commands, with at least one steering command of the one or more steering commands being based on the movement data. The computer program product is configured, when executed, to cause the at least one processor to cause rotation of the trolling motor based on the steering command to cause the watercraft to travel in a new heading direction when the trolling motor is in the water and when the trolling motor is operating, to detect the joystick shifting from the non-neutral position to the neutral position, and to cause, in response thereto, the trolling motor to continue operating so that the watercraft continues to travel in the new heading direction after the joystick has shifted to the neutral position.

BRIEF DESCRIPTION OF THE DRAWINGS

Figure 1:
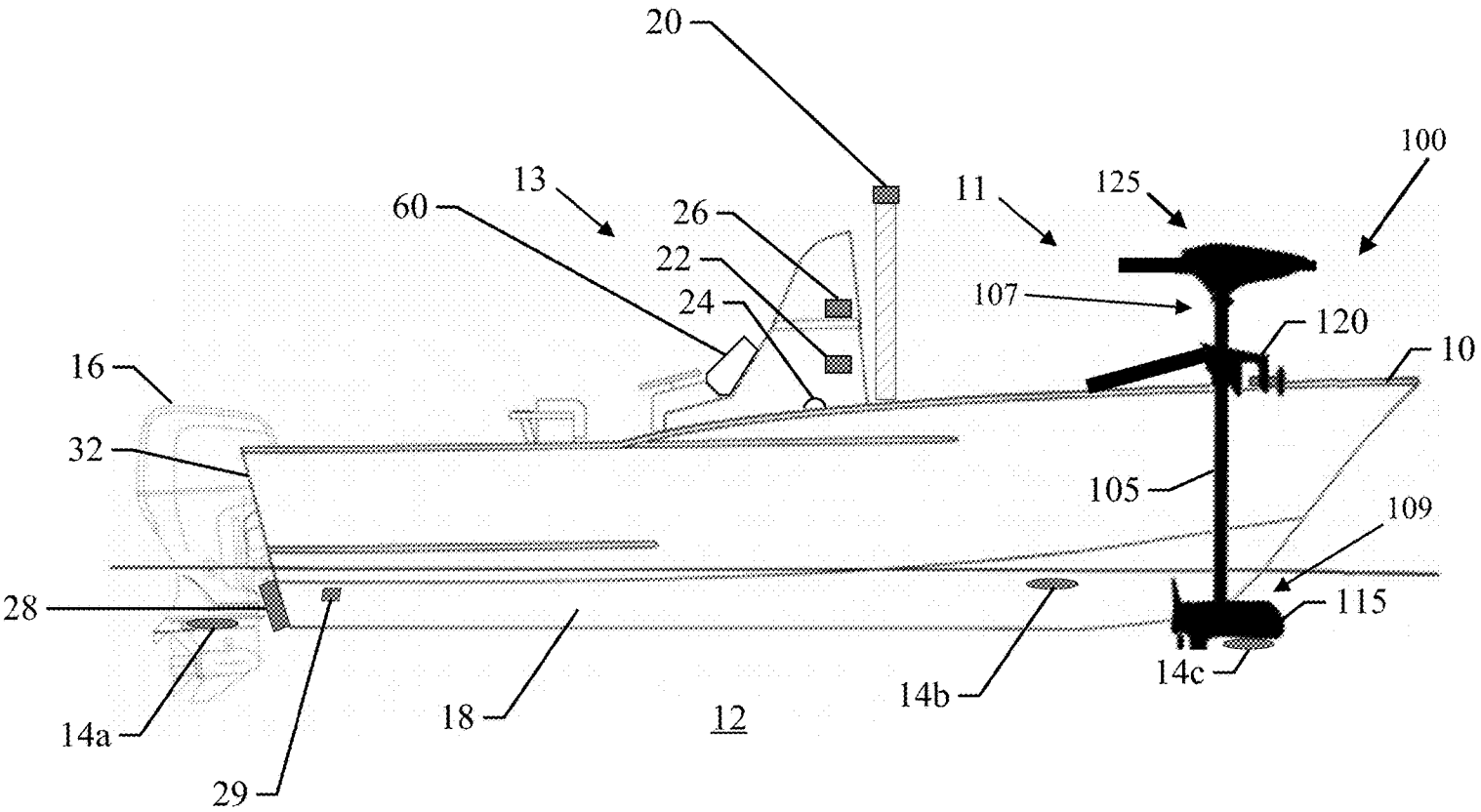
Figure 2:
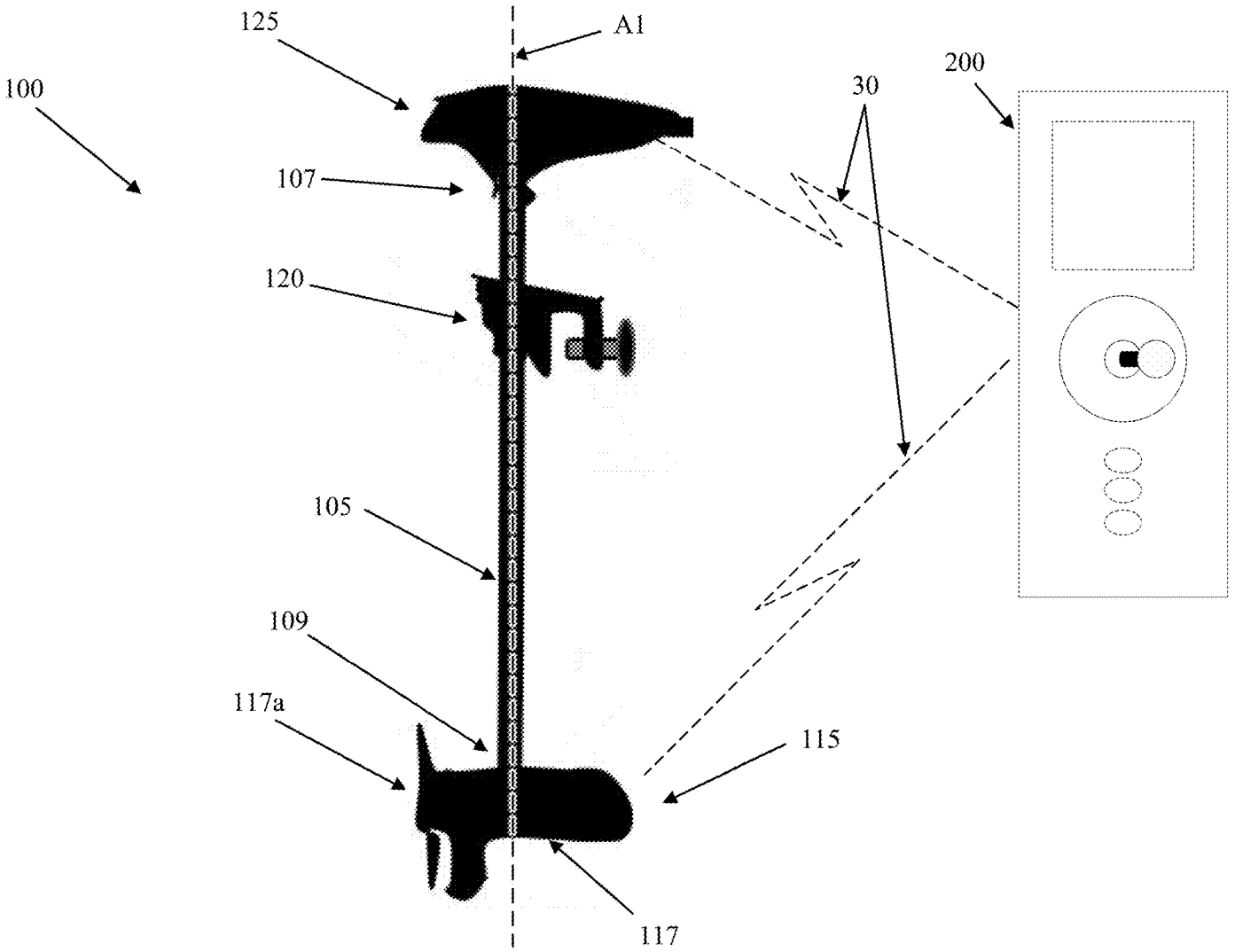
Figure 3A:
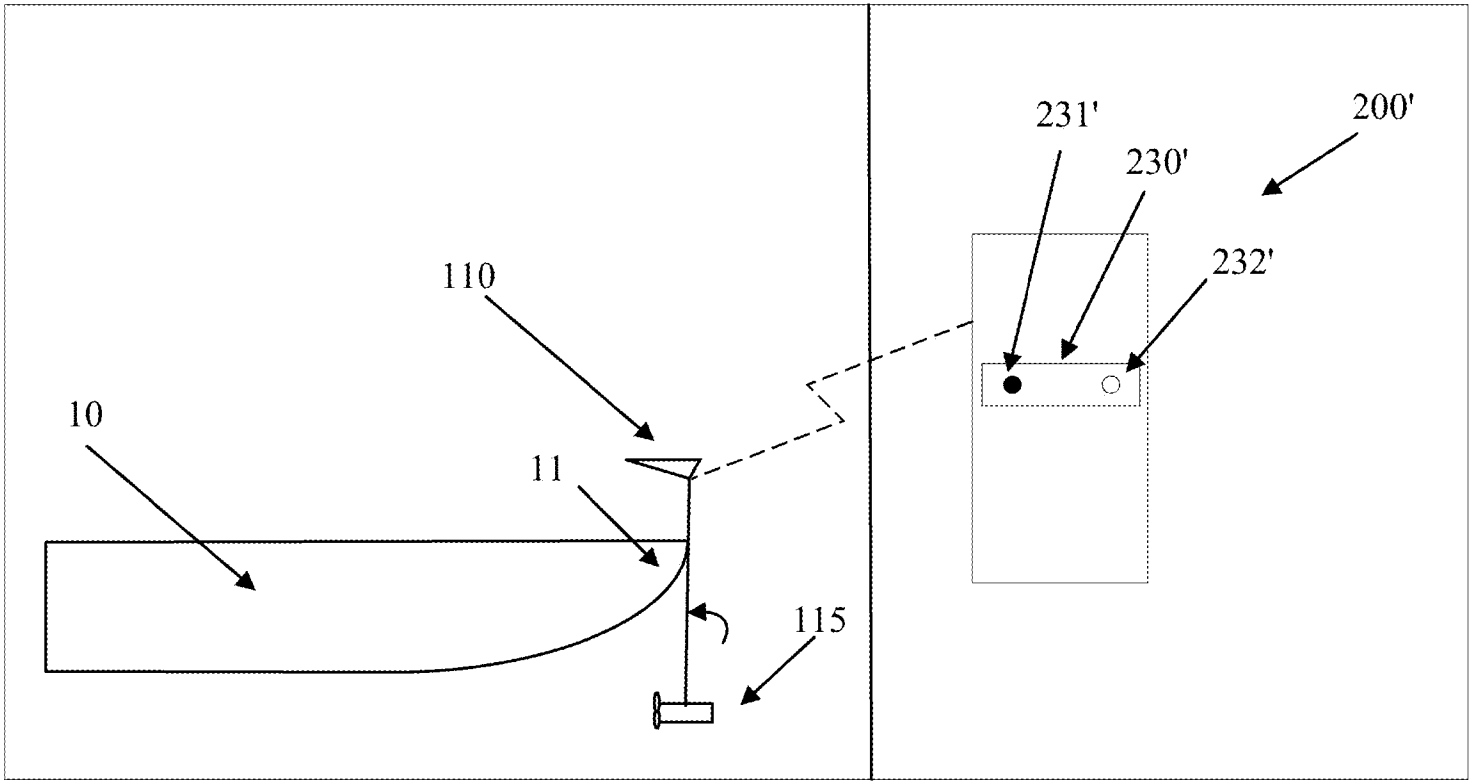
Figure 3B:
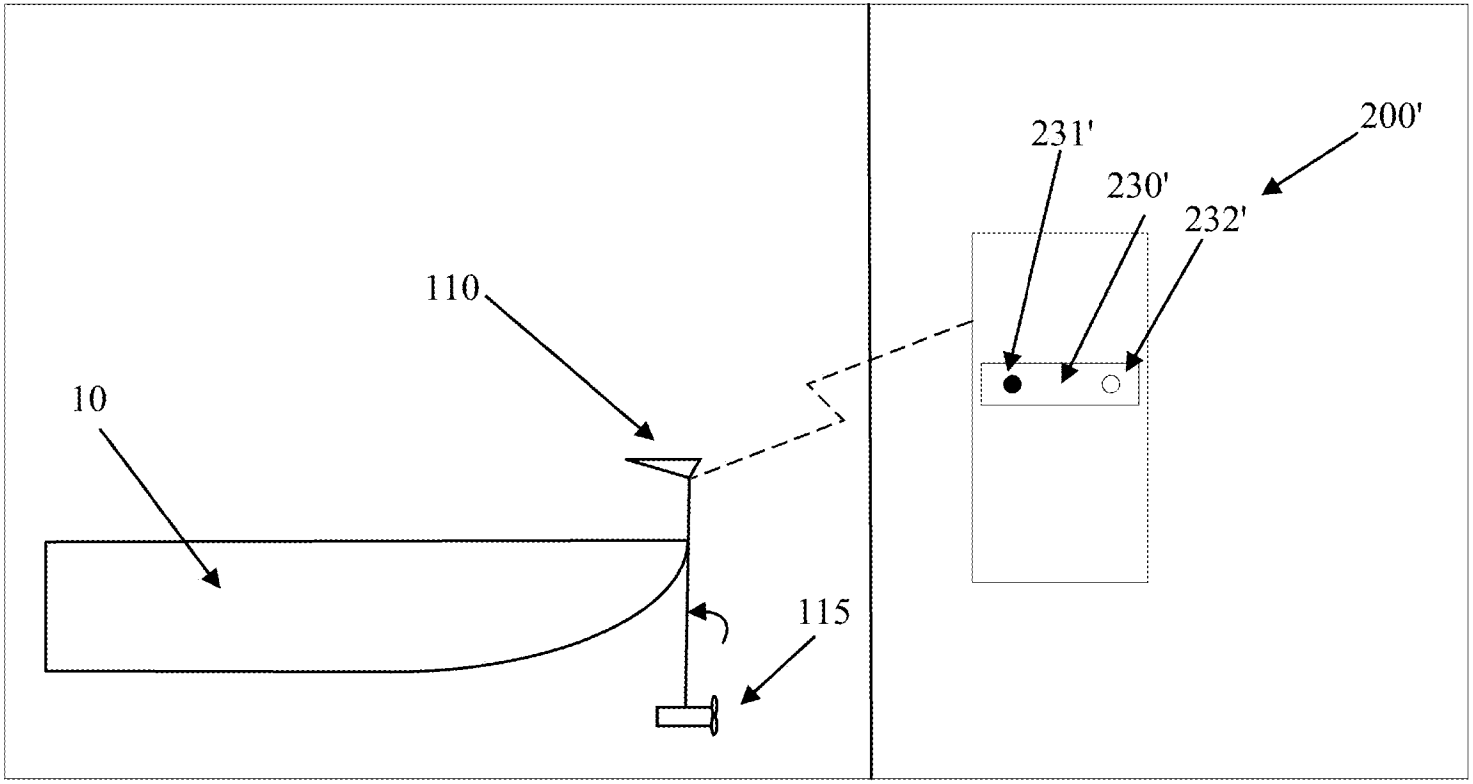
Figure 4B:
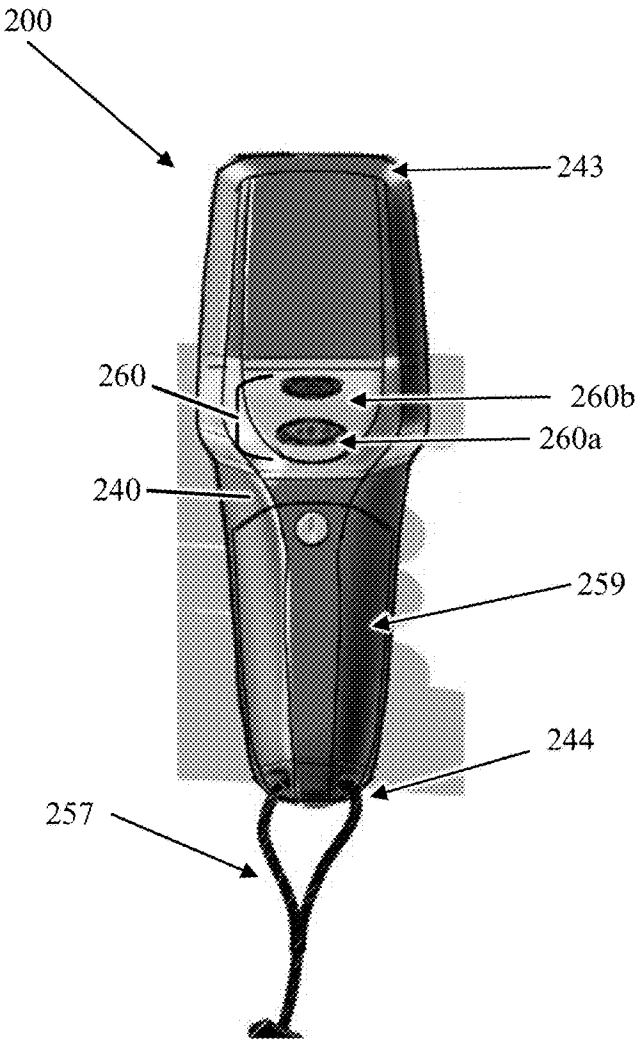
Figure 4A:
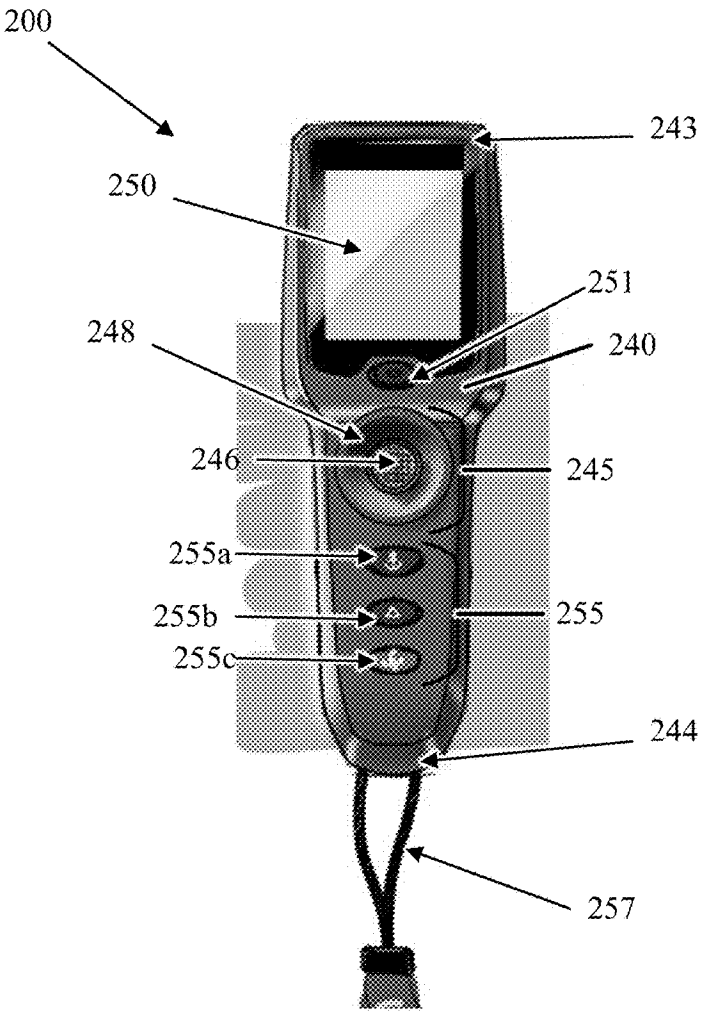
Figure 4C:
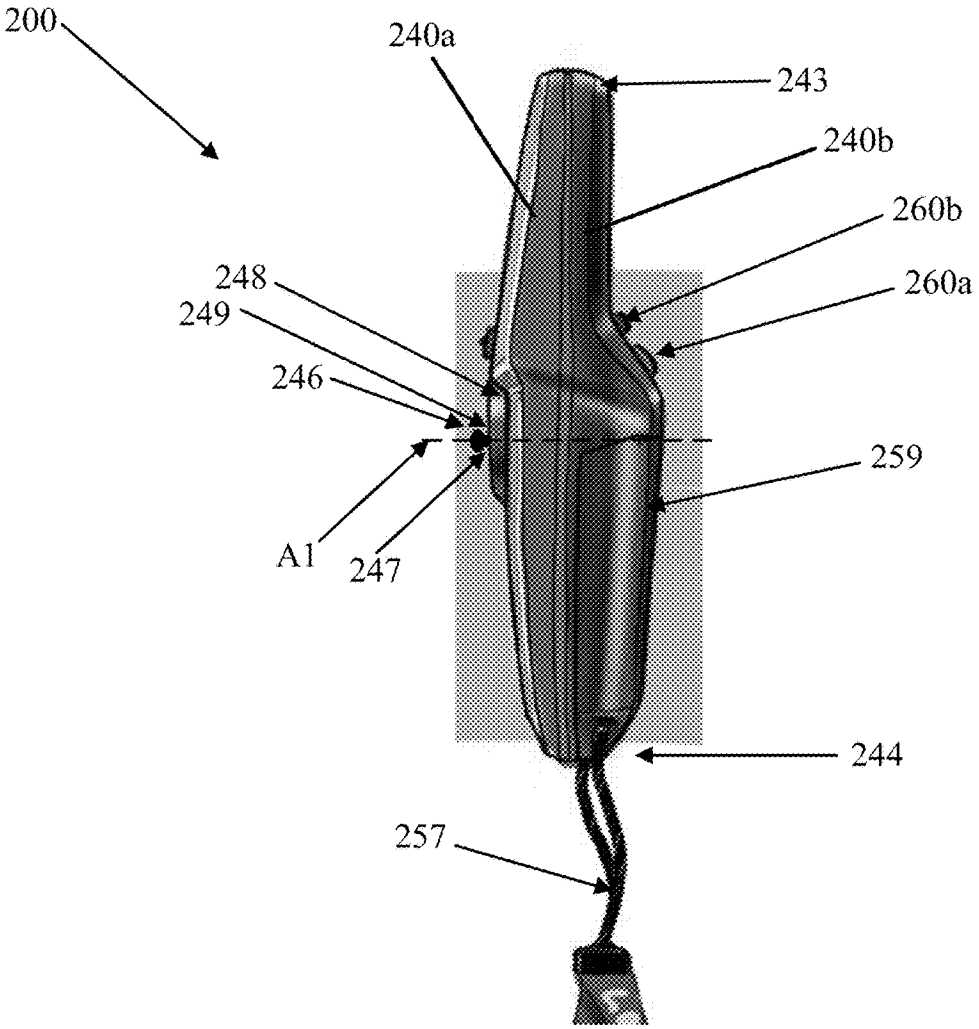
Figure 4D:
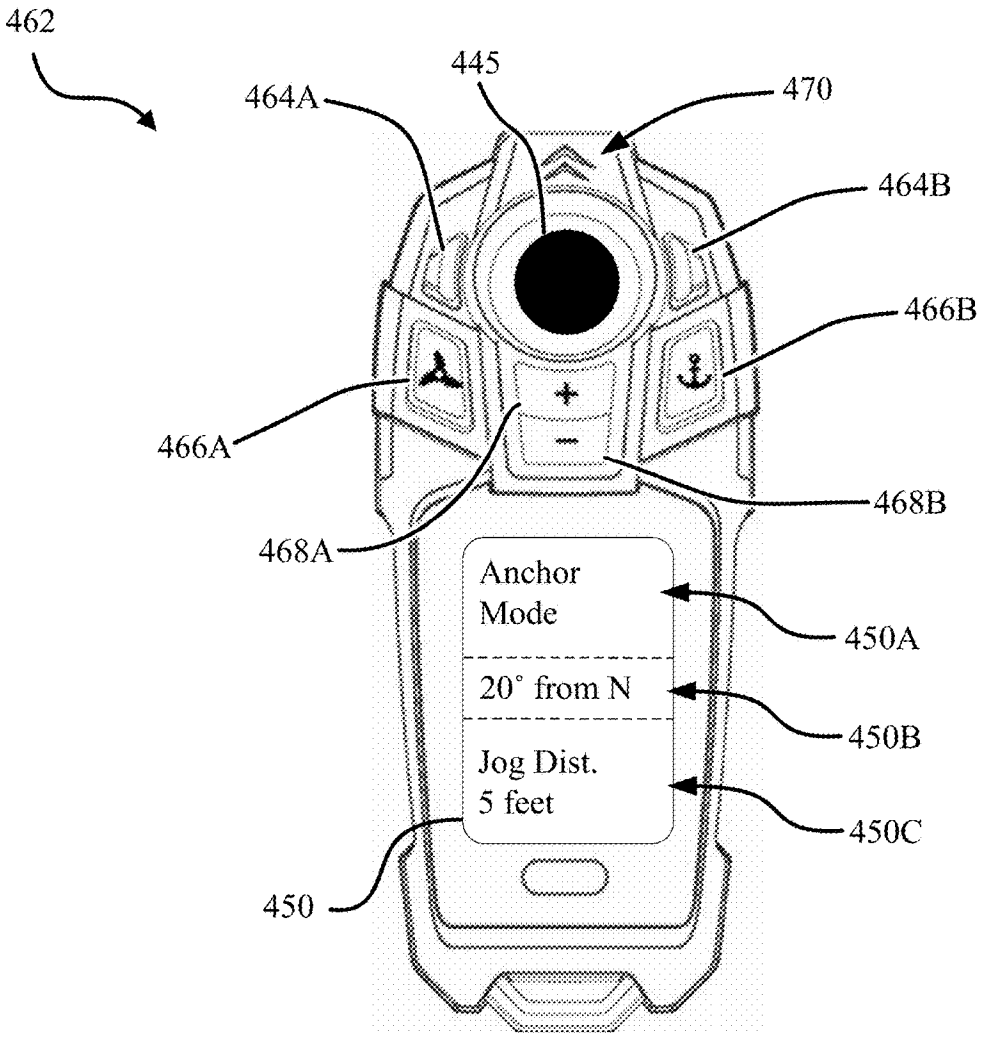
Figure 5A:
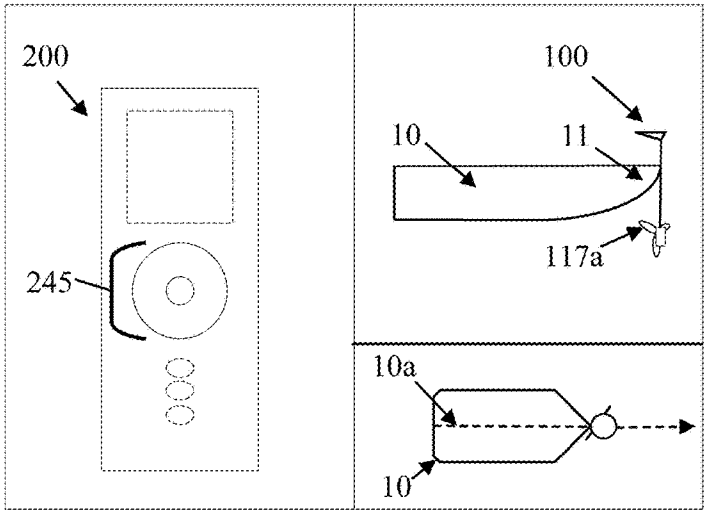
Figure 5B:
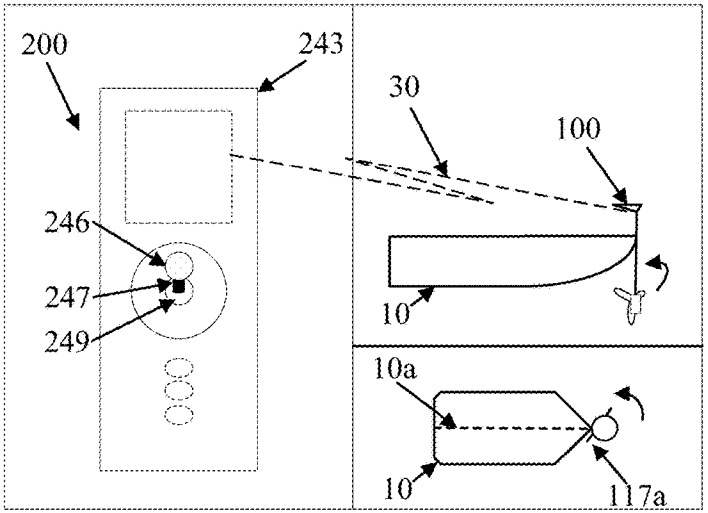
Figure 5C:
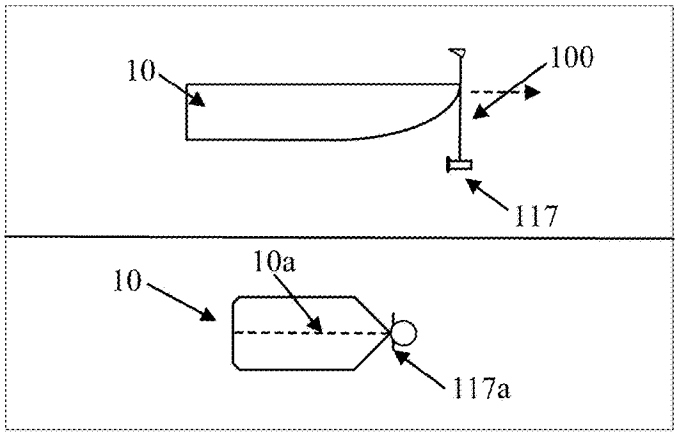
Figure 6B:
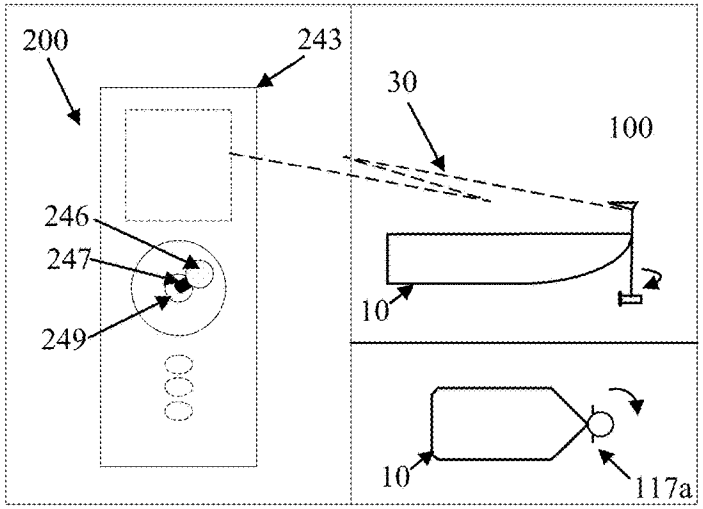
Figure 6A:
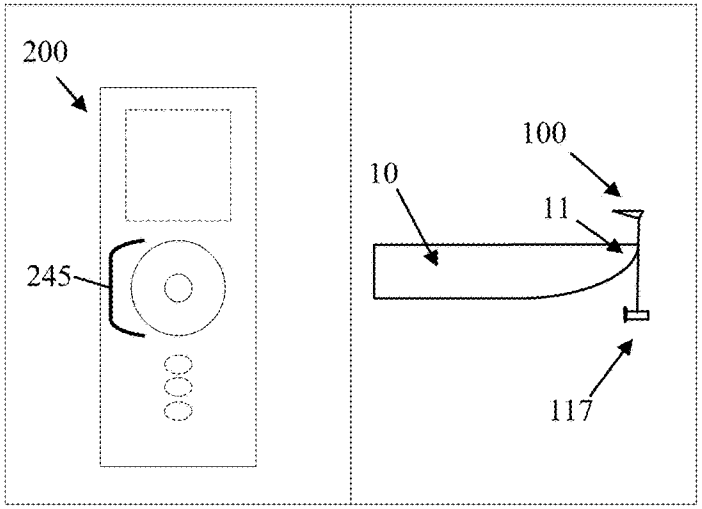
Figure 6C:
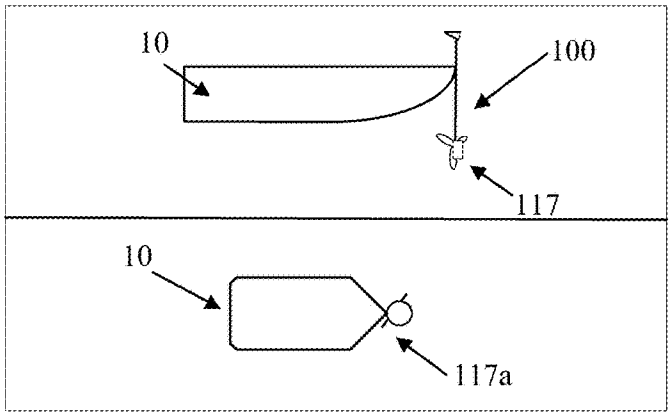
Figure 7A:
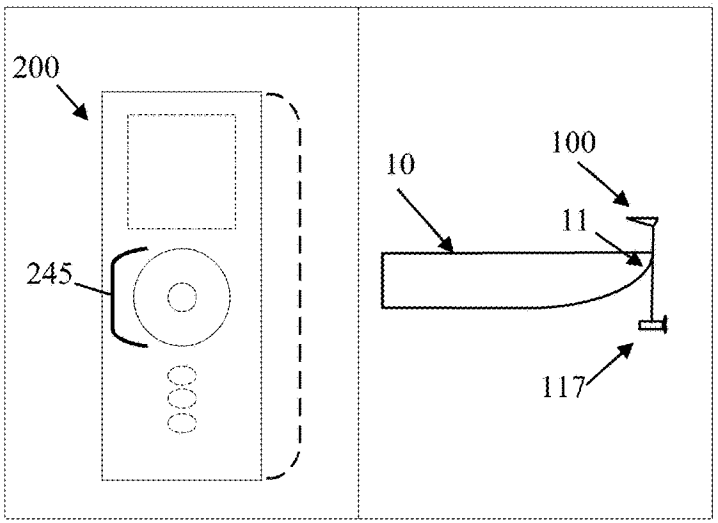
Figure 7B:
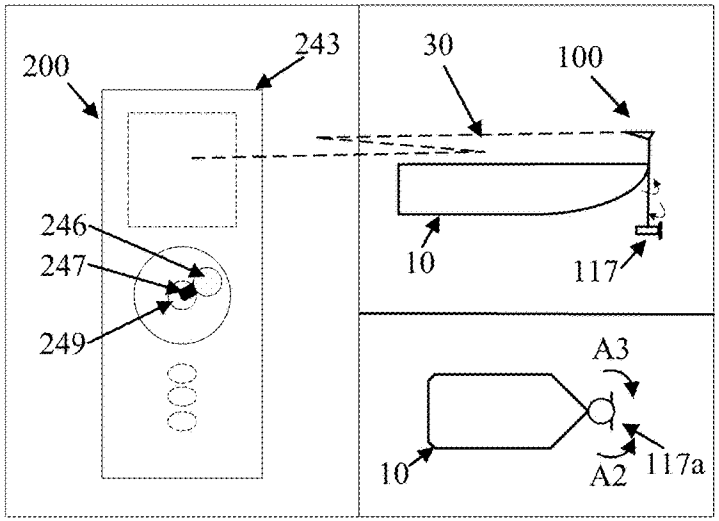
Figure 7C:
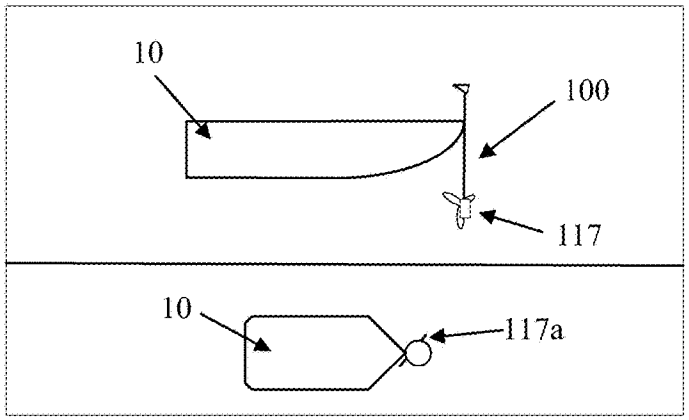
Figure 8A:
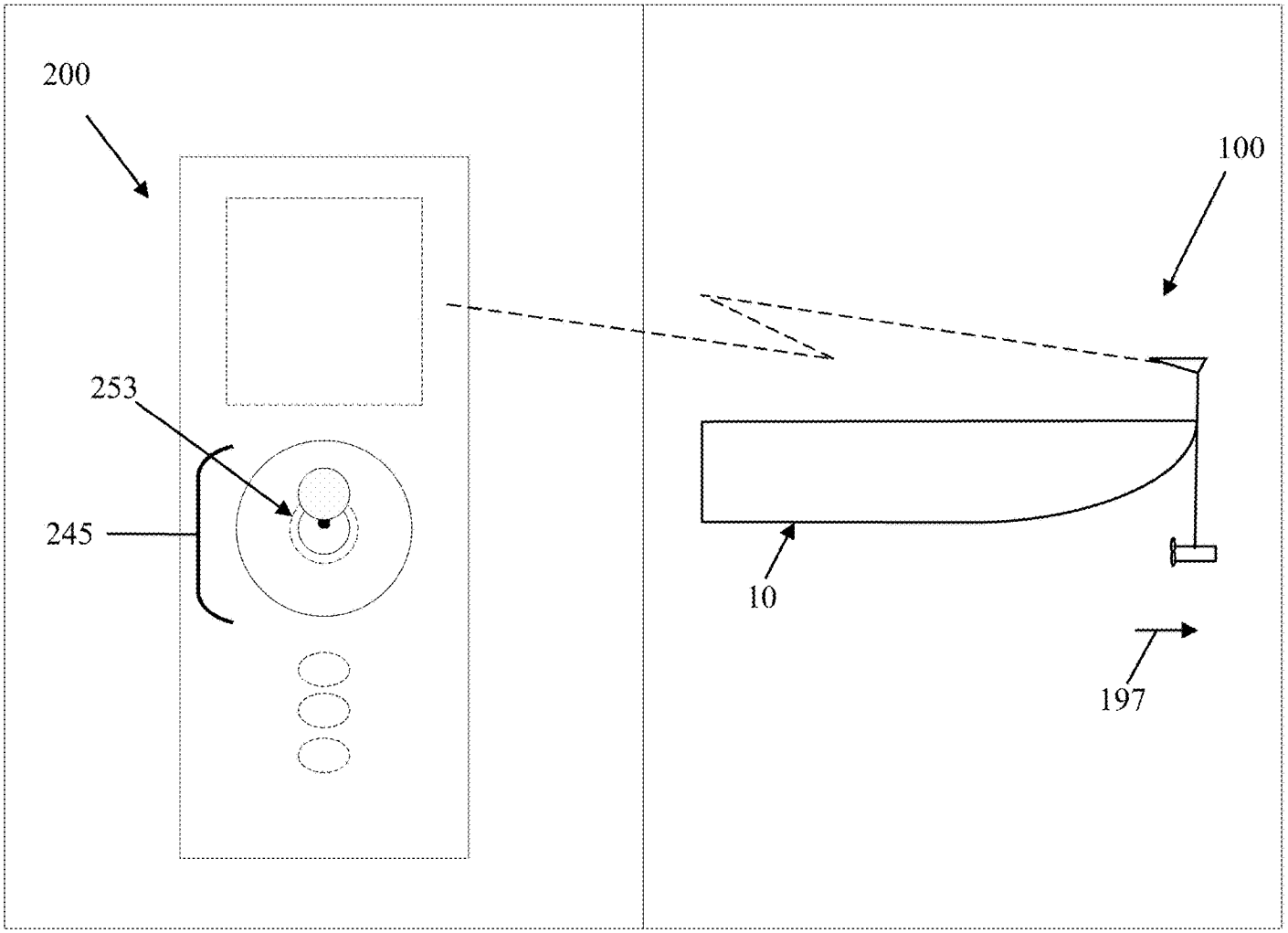
Figure 8B:
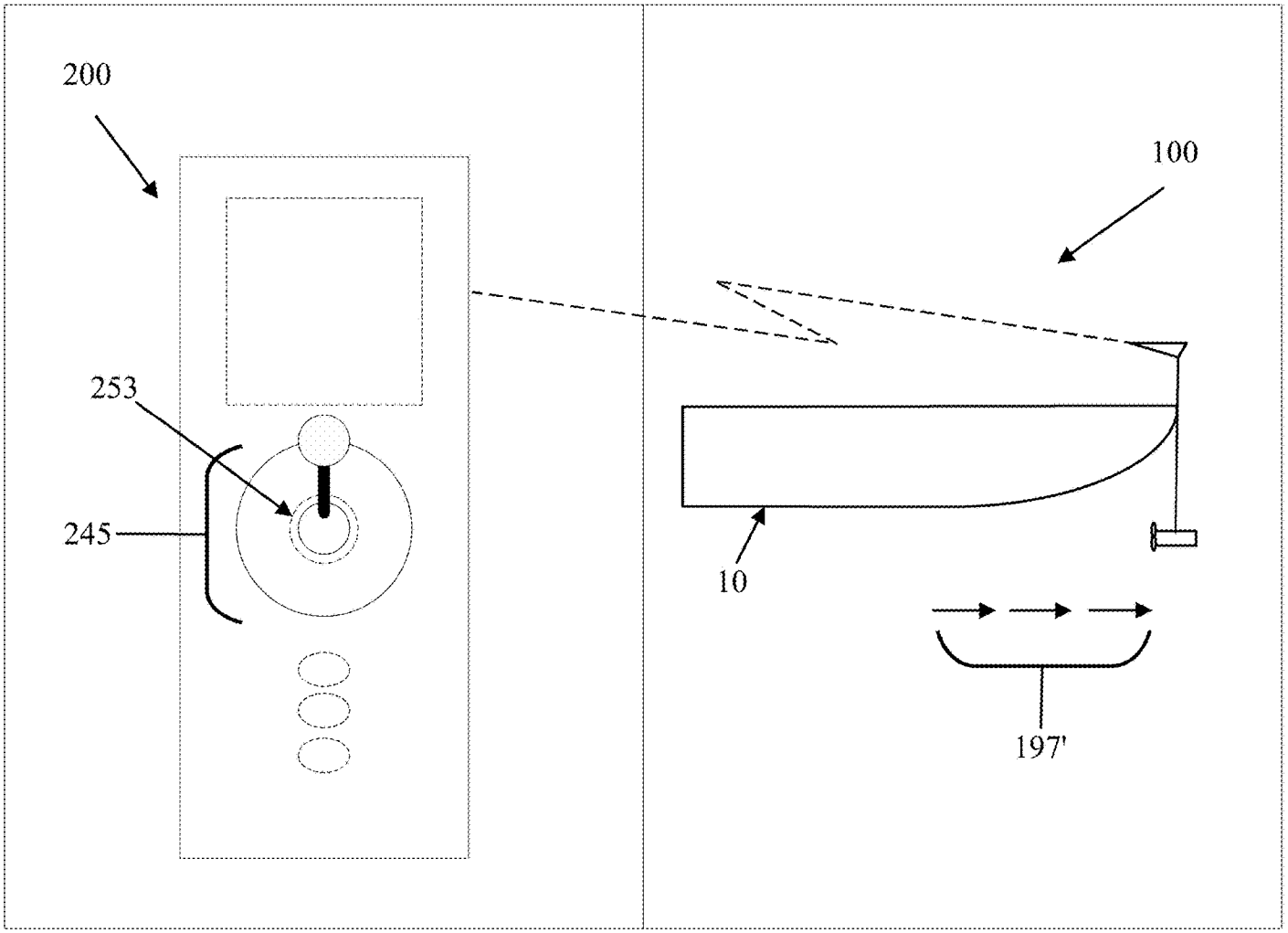
Figure 9:
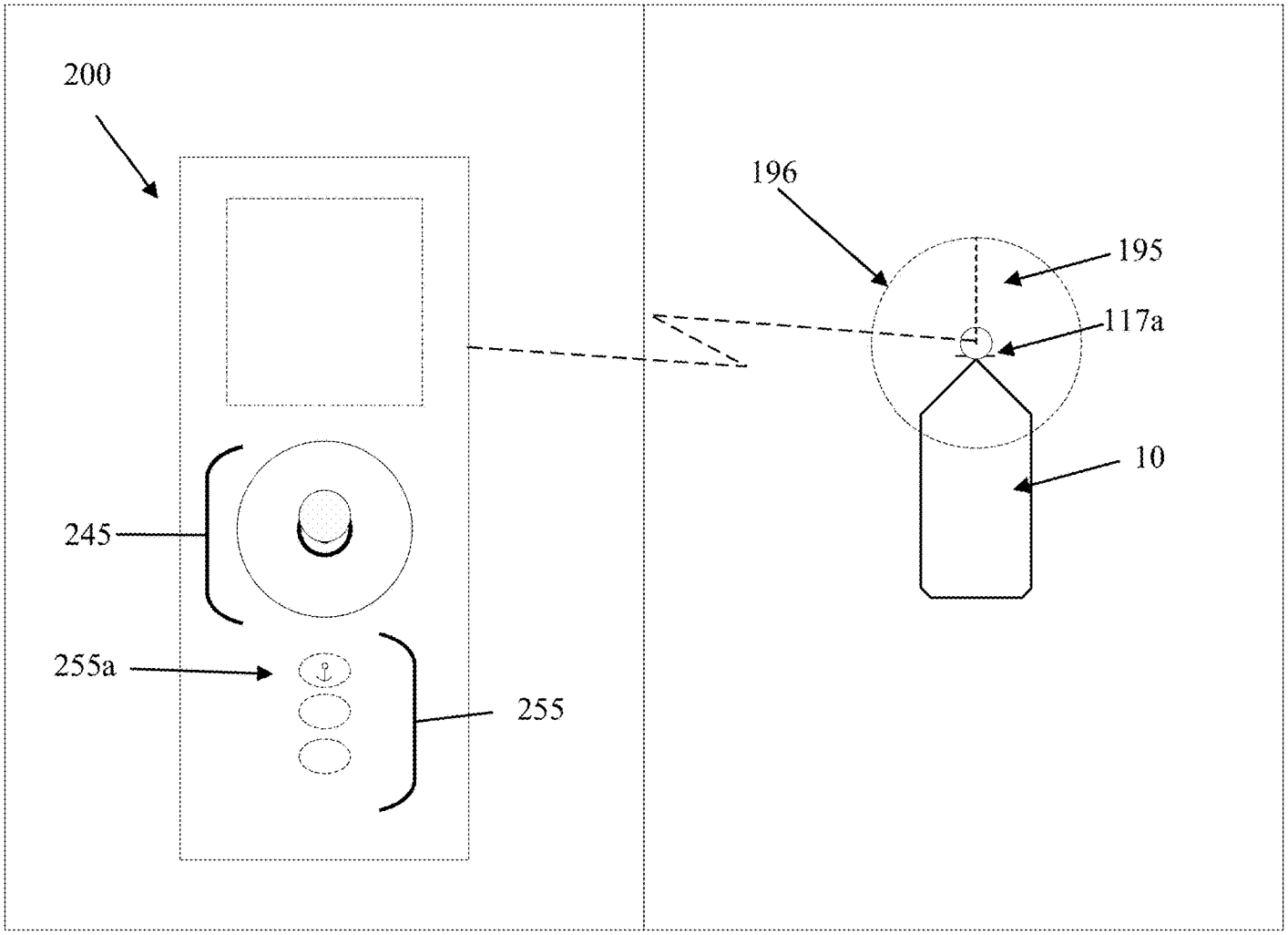
Figure 10A:
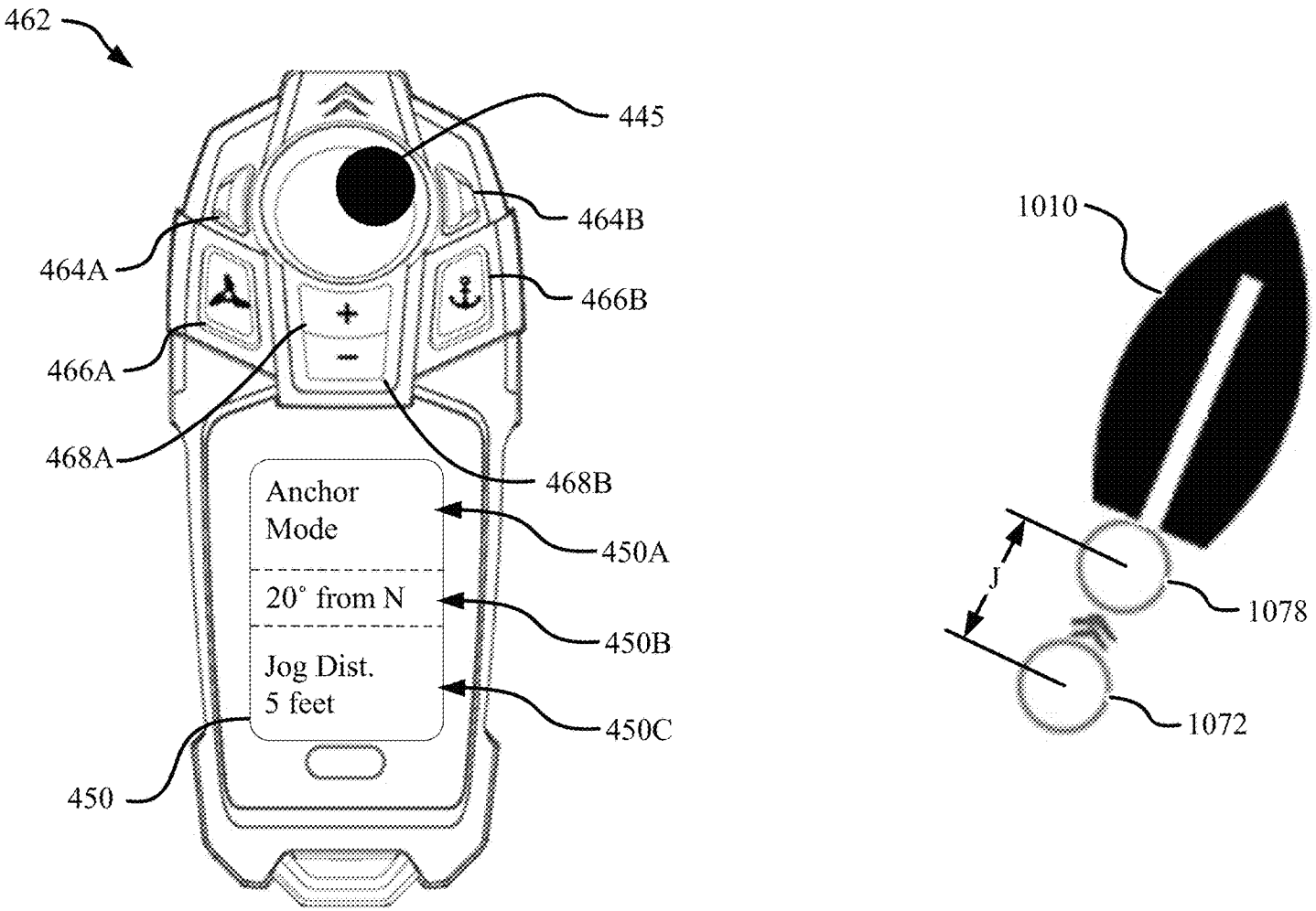
Figure 10C:
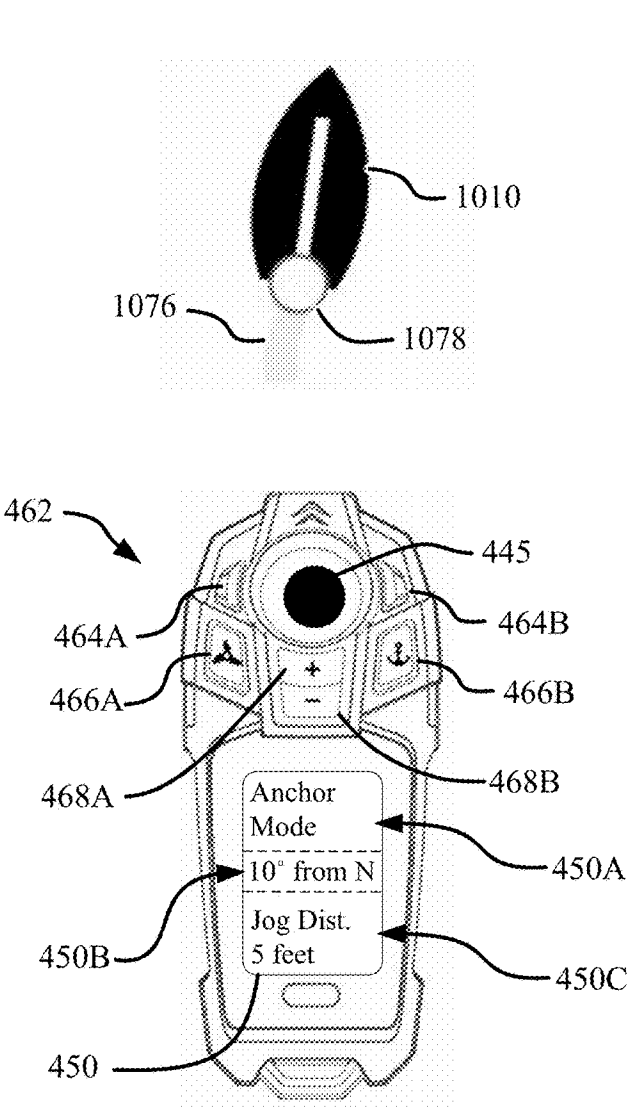
Figure 10B:
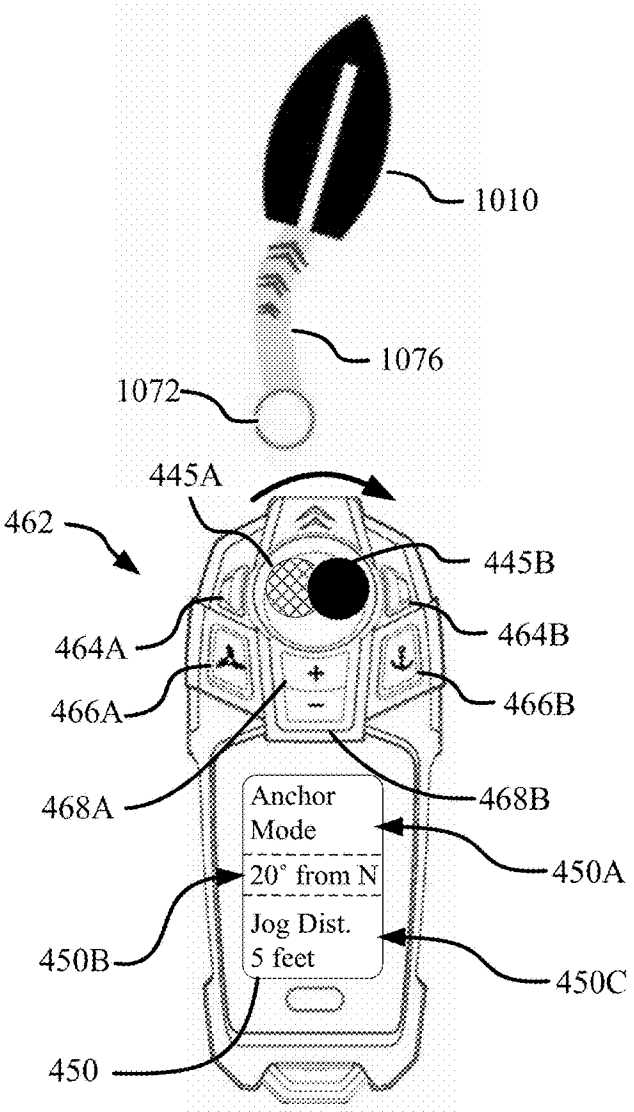
Figure 10D:
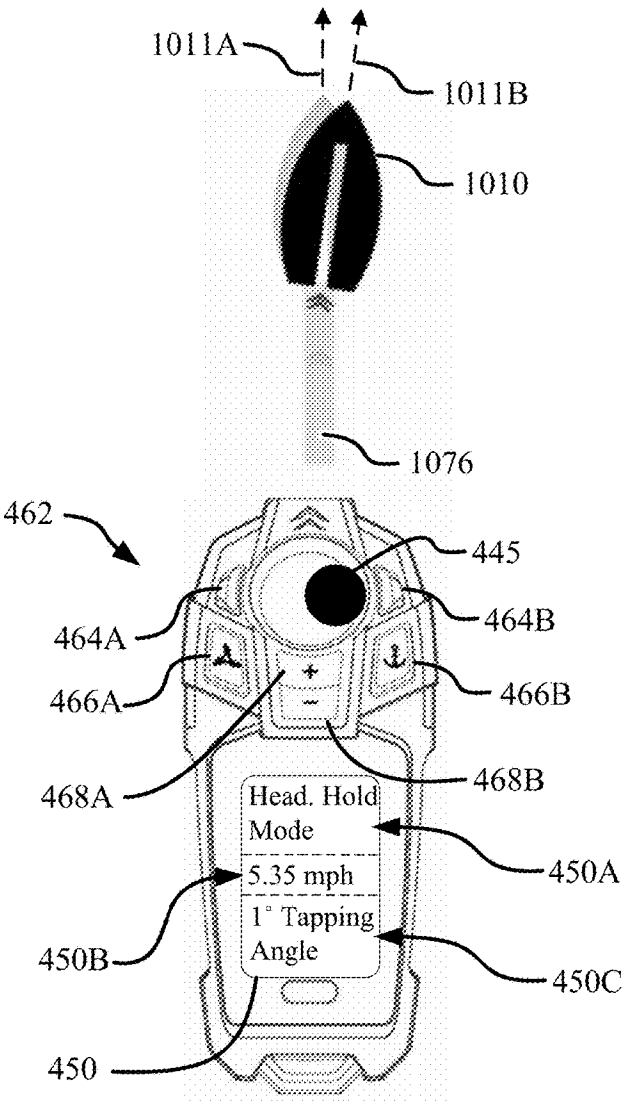
Figure 10F:
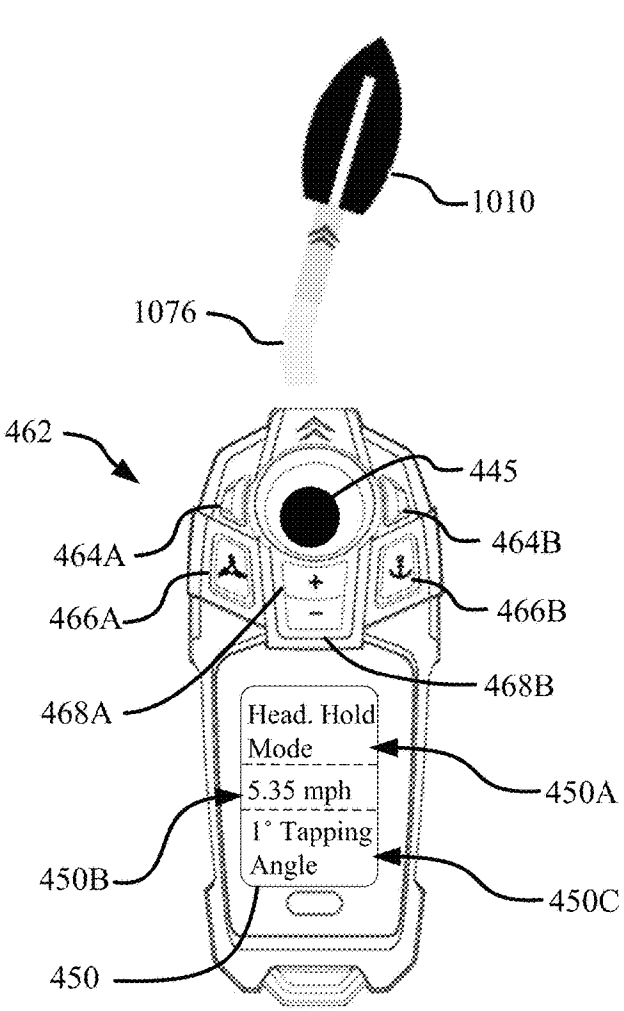
Figure 10E:
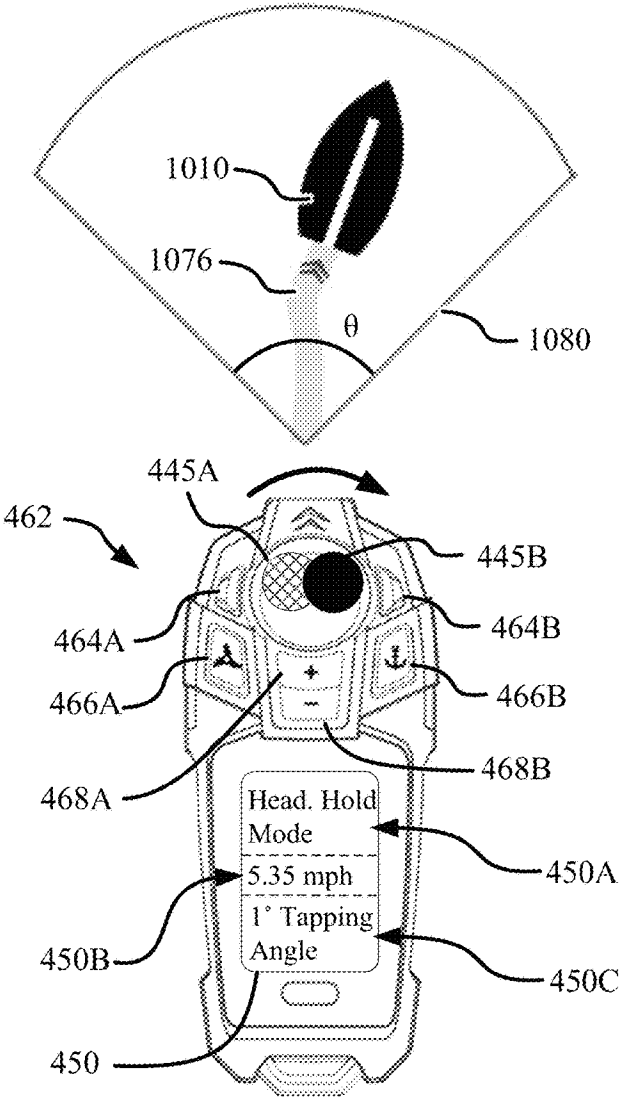
Figure 11:
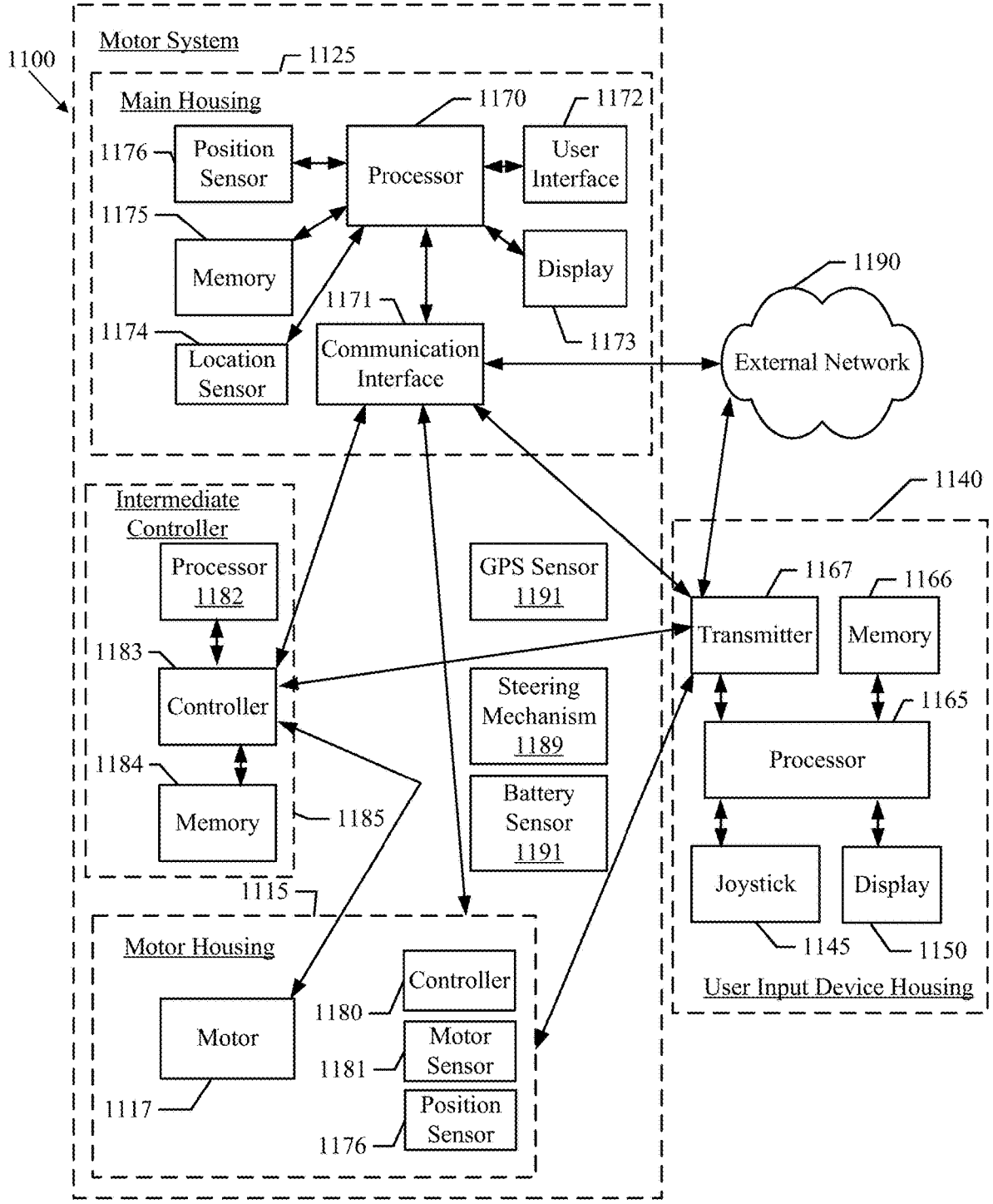
Figure 12:
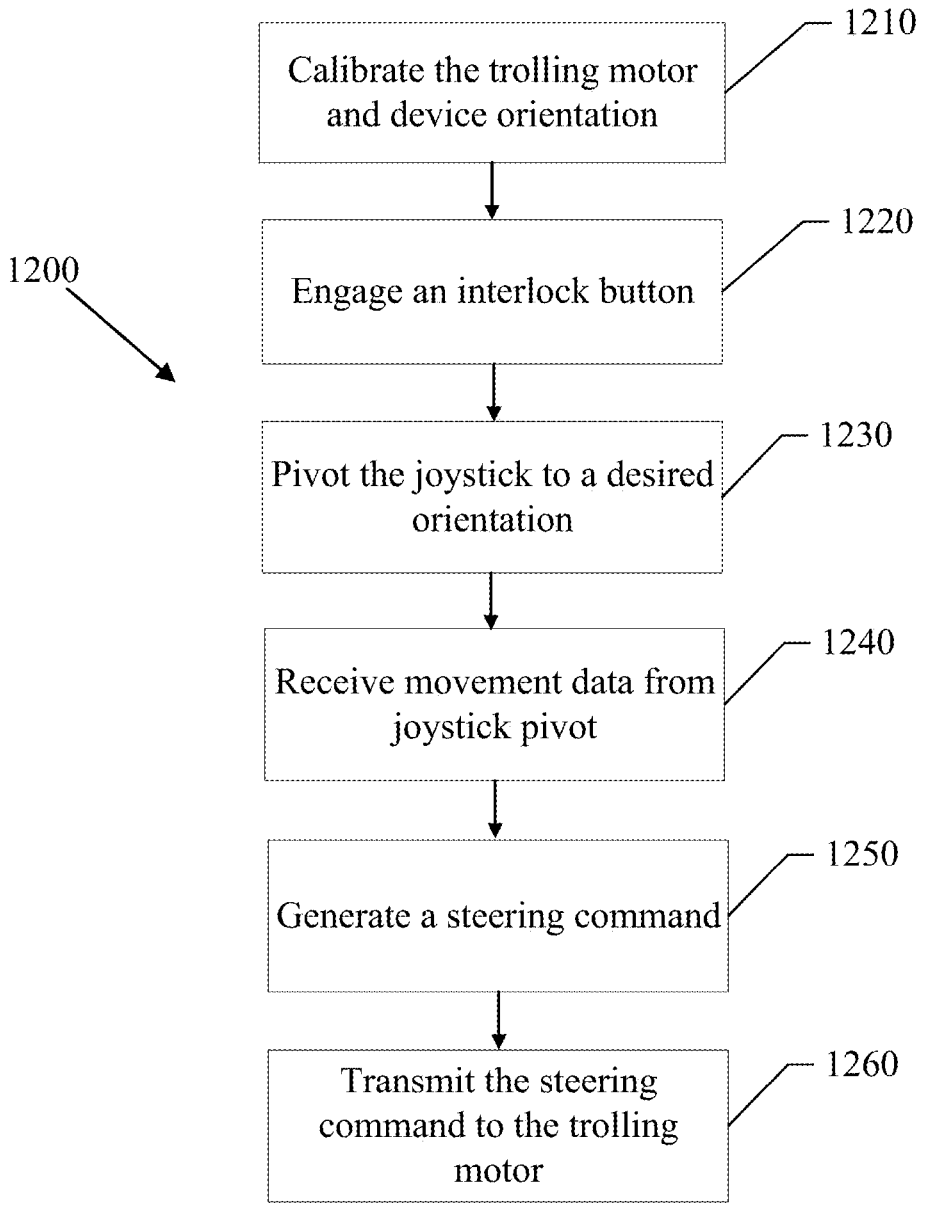
Figure 13:
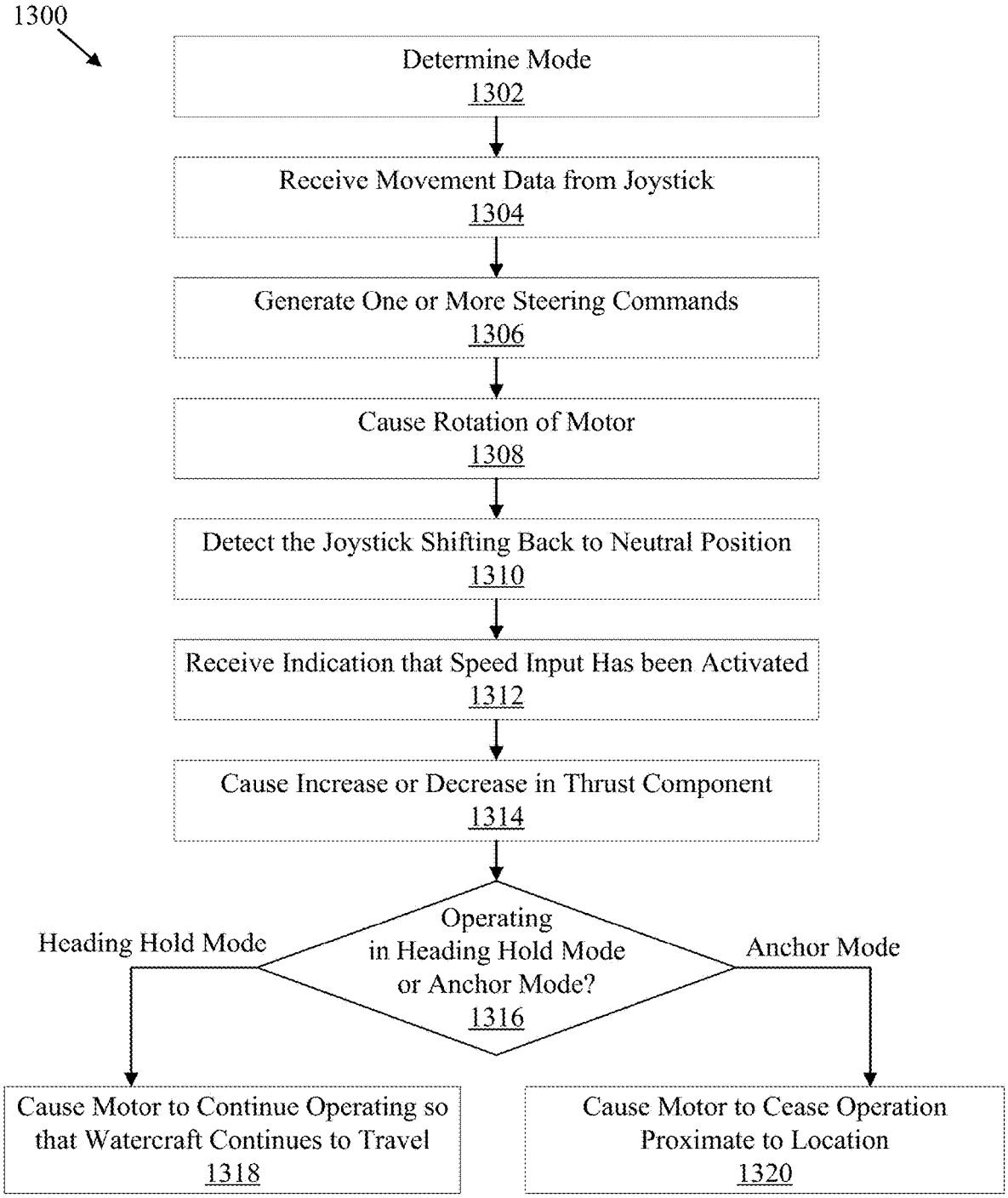
Figure 14:
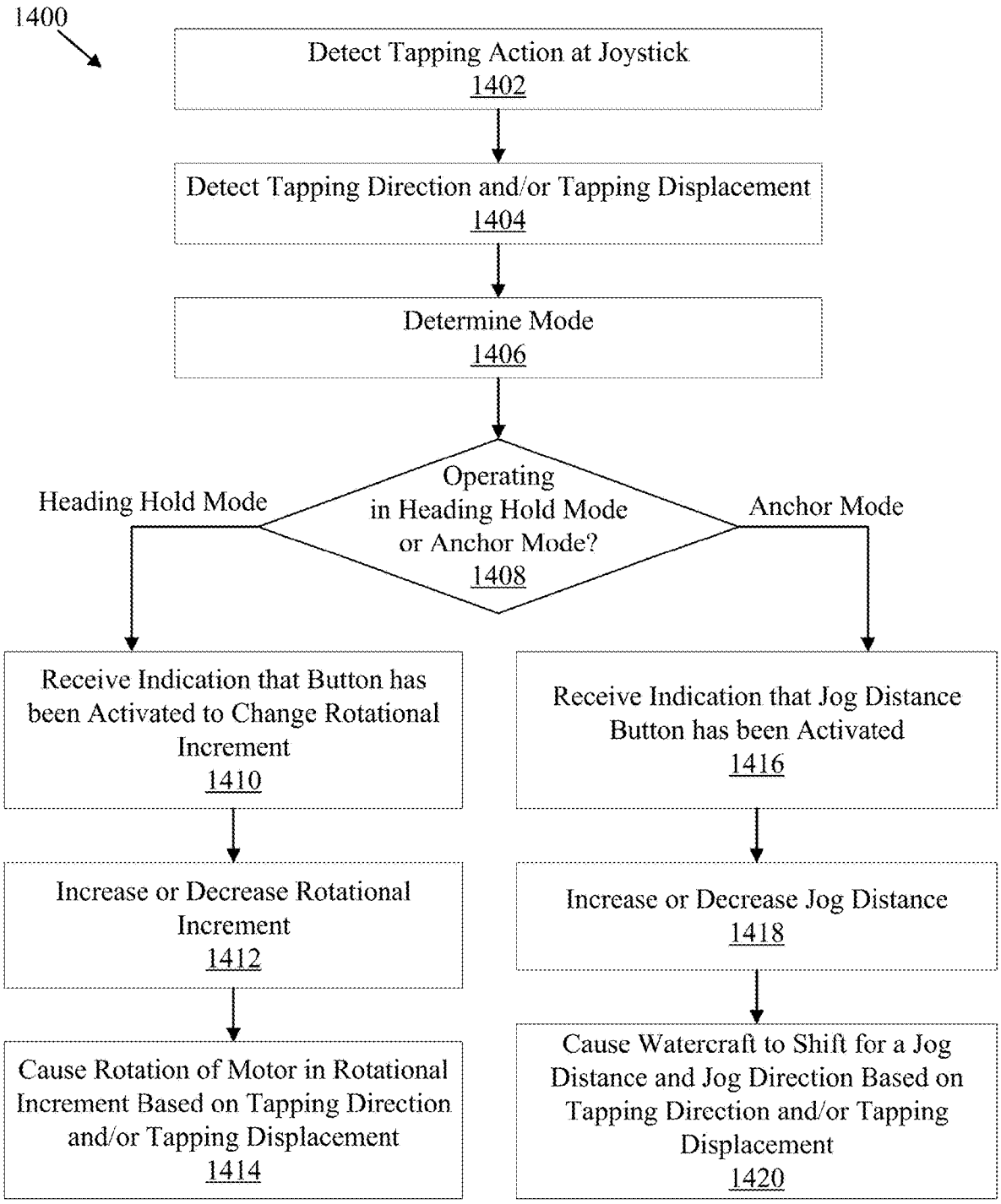

Having thus described the invention in general terms, reference will now be made to the accompanying drawings, which are not necessarily drawn to scale, and wherein:

FIG. 1 illustrates an example trolling motor attached to a front of a watercraft, in accordance with some embodiments discussed herein;

FIG. 2 illustrates an example trolling motor system, in accordance with some embodiments discussed herein;

FIGS. 3A-3B illustrate an example conventional handheld device being used with a trolling motor to steer the trolling motor, in accordance with some embodiments discussed herein;

FIG. 4A illustrates a front view of an example handheld remote device, in accordance with some embodiments discussed herein;

FIG. 4B illustrates a rear view of the example handheld remote device of FIG. 4A, in accordance with some embodiments discussed herein;

FIG. 4C illustrates a side view of the example handheld remote device of FIG. 4A, in accordance with some embodiments discussed herein;

FIG. 4D illustrates a top view of an example handheld remote device, in accordance with some embodiments discussed herein;

FIGS. 5A-5C illustrate an example handheld remote device being used to steer a trolling motor of a watercraft, in accordance with some embodiments discussed herein;

FIGS. 6A-6C illustrate an example handheld remote device being used to steer a trolling motor of a watercraft, in accordance with some embodiments discussed herein;

FIGS. 7A-7C illustrate an example handheld remote device being used to steer a trolling motor of a watercraft, in accordance with some embodiments discussed herein;

FIGS. 8A-8B illustrate an example handheld remote device being used to control a speed component of a trolling motor of a watercraft, in accordance with some embodiments discussed herein;

FIG. 9 illustrates an example handheld device being used to engage a virtual anchoring protocol for a trolling motor, in accordance with some embodiments discussed herein;

FIG. 10A is a schematic view illustrating an example handheld remote device being used to move a watercraft in an anchor mode, in accordance with some embodiments discussed herein;

FIGS. 10B-10C are schematic views illustrating the example handheld remote device of FIG. 10A being used to move a watercraft in an anchor mode, in accordance with some embodiments discussed herein;

FIG. 10D is a schematic view illustrating the example handheld remote device of FIG. 10A being used to move a watercraft in a heading hold mode, in accordance with some embodiments discussed herein;

FIG. 10E is a schematic view illustrating the example handheld remote device of FIG. 10A being used to move a watercraft in a heading hold mode, in accordance with some embodiments discussed herein;

FIG. 10F is a schematic view illustrating the example handheld remote device of FIG. 10A being used to move a watercraft in a heading hold mode, in accordance with some embodiments discussed herein;

FIG. 11 shows a block diagram illustrating a marine system including an example user input device (e.g., handheld, mounted, etc.), in accordance with some embodiments discussed herein;

FIG. 12 illustrates a flow chart of an example method for steering the trolling motor with the example user input device, in accordance with some embodiments discussed herein;

FIG. 13 illustrates a flow chart of an example method for operating a motor on a watercraft, in accordance with some embodiments discussed herein; and FIG. 14 illustrates a flow chart of an example method for causing incremental changes in the position or heading direction of the watercraft based on tapping motions at a joystick, in accordance with some embodiments discussed herein.

DETAILED DESCRIPTION

Example embodiments of the present invention now will be described more fully hereinafter with reference to the accompanying drawings, in which some, but not all embodiments of the invention are shown. Indeed, the invention may be embodied in many different forms and should not be construed as limited to the example embodiments set forth herein; rather, these embodiments are provided so that this disclosure will satisfy applicable legal requirements. Any connections or attachments may be direct or indirect connections or attachments unless specifically noted otherwise. Not all drawings are drawn to scale.

As used herein the term "forward" is used to describe the direction of the heading of the watercraft 10, such as directed outwardly in line with a centerline of the watercraft and from the fore part 11 of the watercraft 10 (see FIGS. 5B-5C).

FIG. 1 illustrates an example watercraft 10 including various marine devices, in accordance with some embodiments discussed herein. As depicted in FIG. 1, the watercraft 10 (e.g., a vessel) is configured to traverse a marine environment, e.g. body of water 12, and may use one or more sonar transducer assemblies 14*a*, 14*b*, and 14*c* disposed on and/or proximate to the watercraft. Notably, example watercraft contemplated herein may be surface watercraft, submersible watercraft, or any other implementation known to those skilled in the art. The sonar transducer assemblies 14*a*, 14*b*, and 14*c* may each include one or more transducer elements (such as in the form of the example assemblies described herein) configured to transmit sound waves into a body of water, receive sonar returns from the body of water, and convert the sonar returns into sonar return data. Various types of sonar transducers may be provided for example, a linear downscan sonar transducer, a conical downscan sonar transducer, a sonar transducer array, or a sidescan sonar transducer may be used.

Depending on the configuration, the watercraft 10 may include a primary motor 16, which may be a main propulsion motor such as an outboard or inboard motor. The watercraft 10 has a trolling motor assembly 100 attached to its front by a trolling motor mount 121, with a trolling motor housing 115 submerged in the body of water 12. The trolling motor assembly 100 is not drawn to scale in FIG. 1 and certain features of the trolling motor assembly 100 are enlarged in FIG. 1. The trolling motor within the trolling motor housing 115, which may be gas-powered or electric, may be used as a propulsion system to provide thrust so as to cause the watercraft 10 to travel along the surface of the body of water 12. The trolling motor assembly 100 may also include a main housing 125 positioned out of the water and at a top of a shaft 105. While the depicted embodiment shows the trolling motor assembly 100 attached to the fore part 11 of the watercraft 10 as a secondary propulsion system, example embodiments described herein contemplate that the trolling motor assembly 100 may be attached in any position (e.g., the rear or side) on the watercraft 10 and/or may serve as the primary propulsion system for the watercraft 10. Moreover, steering may be accomplished via a remote device. Additionally, in some cases, an autopilot may operate the trolling motor of the trolling motor assembly 100 autonomously.

The trolling motor of the trolling motor assembly 100 may be configured to propel the watercraft 10 and/or maintain a position. The one or more sonar transducer assemblies (e.g., 14*a*, 14*b*, and/or 14*c*) may be mounted in various positions and to various portions of the watercraft 10 and/or equipment associated with the watercraft 10. For example, the sonar transducer assembly may be mounted to the transom 32 of the watercraft 10, such as depicted by sonar transducer assembly 14*a*. The sonar transducer assembly may be mounted to the bottom or side of the hull 18 of the watercraft 10, such as depicted by sonar transducer assembly 14*b*. The sonar transducer assembly may be mounted to the trolling motor assembly 100, such as depicted by sonar transducer assembly 14*c*.

The watercraft 10 may also include one or more marine electronic devices 60, such as may be utilized by a user to interact with, view, or otherwise control various aspects of the various sonar systems described herein. In the illustrated embodiment, the marine electronic device 60 is positioned proximate the helm 13 (e.g., steering wheel) of the watercraft 10 although other positions on the watercraft 10 are contemplated. Likewise, additionally or alternatively, a remote device (such as a user's mobile device) may include functionality of a marine electronic device.

The watercraft 10 may also comprise other components within the one or more marine electronic devices 60 or at the helm 13. In FIG. 1, the watercraft 10 comprises a radar 20, which is mounted at an elevated position (although other positions relative to the watercraft are also contemplated). The watercraft 10 also comprises an AIS transceiver 22, a direction sensor 24, and a camera 26, and these components are each positioned at or near the helm 13 (although other positions relative to the watercraft 10 are also contemplated). Additionally, the watercraft 10 comprises a rudder 28 at the stern of the watercraft 10, and the rudder 28 may be positioned on the watercraft 10 so that the rudder 28 will rest in the body of water 12. In other embodiments, these components may be integrated into the one or more marine electronic devices 60 or other devices. Another example device on the watercraft 10 includes a temperature sensor 29 that may be positioned so that it will rest within or outside of the body of water 12. Other example devices include a wind sensor, one or more speakers, and various vessel devices/features (e.g., doors, bilge pump, fuel tank, etc.), among other things. Additionally, one or more sensors may be associated with marine devices; for example, a sensor may be provided to detect the position of the primary motor 16, the trolling motor assembly 100, or the rudder 28.

FIG. 2 illustrates an example trolling motor assembly 100. The trolling motor assembly 100 may include a shaft 105 having a first end 107 and a second end 109 defining a trolling motor shaft axis A1 extending therebetween. The trolling motor assembly 100 may include a main housing 125 attached to the first end 107 of the shaft 105, and a trolling motor housing 115 attached to the second end 109 of the shaft 105. In some embodiments, when the trolling motor assembly 100 is attached to the watercraft 10 (see FIG. 1) and when the trolling motor 117 or trolling motor housing 115 is submerged in the body of water 12 (see FIG. 1), the trolling motor 117 is configured to propel the watercraft 10 to travel along the body of water 12. In addition to containing the trolling motor 117, the trolling motor housing 115 may include other components described herein including, for example, a propeller 117*a*, a sonar transducer assembly 14*c* (see FIG. 1) and/or other sensors.

When the trolling motor assembly 100 is properly installed on a watercraft 10 and the watercraft 10 is on a body of water 12, the main housing 125 is positioned outside of the body of water 12 (see FIG. 1) and is connected to the shaft 105 proximate the first end 107 of the shaft 105. The main housing 125 may be configured to house components of the trolling motor assembly 100, such as may be used for processing marine or sensor data and/or controlling operation of the trolling motor among other things. For example, with reference to FIG. 11, depending on the configuration and features of the trolling motor assembly 100, the main housing 125 may contain, for example, one or more processors 1170, memory 1175, location sensor 1174, position sensor 1176, communication interface 1171, user interface 1172, or a display 1173.

The trolling motor assembly 100 may further include an attachment feature 120 (e.g., a trolling motor mount, a clamp, other attachment means) to enable connection or attachment of the trolling motor assembly 100 to the watercraft 10. In some embodiments, the attachment feature 120 may be configured to aid and assist in rotation of the shaft 105 of the trolling motor about the shaft axis so as to steer the watercraft 10. In other embodiments, the attachment feature 120 may be configured so that it will not hinder the rotation of the shaft 105. In some embodiments, the attachment feature 120 may be configured to remove the trolling motor assembly 100 from the body of water 12 by rotating the trolling motor assembly 100 to the deck of the watercraft 10 (e.g. to rotate the trolling motor assembly 100 clockwise or counterclockwise from the perspective illustrated in FIG. 2), or by removing the trolling motor assembly 100 from the watercraft 10.

The trolling motor assembly 100 may be in electrical communication with a remote device 200. As illustrated in FIG. 2, signals 30 may be sent between the remote device 200 and the trolling motor assembly 100. In some embodiments, the remote device 200 may be in communication with the main housing 125, the trolling motor housing 115, an external network 1190 (see FIG. 11), and/or an intermediate controller 1185 (see FIG. 11). In some embodiments, the remote device 200 may be handheld so that it may be used at any location within the watercraft 10. In other embodiments, the remote device 200 may be mounted at the helm 13 (see FIG. 1) of the watercraft 10. In some embodiments, the intermediate controller 1185 may be mounted at the helm 13, or within the remote device 200.

Although previous remote devices have been used to steer trolling motors, they afford minimal utility. As illustrated in FIG. 3A, a conventional handheld device 200' includes a push pad 230' having a left side button 231' and a right side button 232'. When the left side button 231' is pressed, the trolling motor housing 115 rotates counterclockwise, and when the right side button 232' is pressed the trolling motor housing 115 rotates clockwise. The trolling motor housing 115 will continue to rotate while either the left side button 231' or the right side button 232' is engaged, and the trolling motor housing 115 will cease rotation upon disengagement. Although there may be an indication of the trolling motor orientation indicated on the trolling motor main housing 110, in order to achieve a desired direction, either the left side button 231' or the right side button 232' must be disengaged at exactly the right time to reach the desired orientation of the trolling motor housing 115 without overshooting.

FIG. 3A illustrates a case where the trolling motor housing 115 is oriented to propel the watercraft 10 forward in relation to the fore part 11 of the watercraft 10. A user may engage the left side button 231' to direct the trolling motor housing 115 to rotate counterclockwise (e.g., left) as illustrated by the arrow. Since the trolling motor was oriented in the forward direction, the trolling motor housing 115 and thereby the forward facing direction of the watercraft 10 rotates counterclockwise after the trolling motor engages and propels the watercraft 10 a certain distance.

However, in some embodiments, when the trolling motor housing 115 is not aligned with the forward facing direction, engagement with either the left side button 231' or the right side button 232' will result in a counter intuitive rotation of the trolling motor housing 115. For example, as illustrated in FIG. 3B, the trolling motor housing 115 is oriented to propel the watercraft 10 opposite the forward direction. Engaging the left side button 231' will rotate the trolling motor housing 115 counterclockwise from the starting orientation. In the present example, the trolling motor housing 115 would rotate counterclockwise, such that the propeller 117*a* of the trolling motor 117 has rotated to the left in relation to the forward direction. When the trolling motor 117 is engaged, the watercraft 10 will rotate clockwise due to the orientation of the trolling motor 117 housing (and the mounting of the trolling motor on the fore part 11 of the watercraft 10).

Therefore, in the present example, the intuitive action, pressing the left side button 231' to rotate the trolling motor 117 and thereby steer the watercraft 10 in the desired direction is incorrect, and will result in the opposite direction of rotation and travel. Accordingly, for a user to accurately steer the watercraft 10, the user must look to the current orientation of the trolling motor (e.g., see the indication on the main housing 110), determine the desired direction, engage the correct button of the push pad 230', and release the button of the push pad 230' at the correct time in order to steer the trolling motor housing 115 and/or the watercraft 10 in the desired direction.

Various embodiments contemplated herein relate to a handheld remote device to steer a trolling motor in a desired direction, regardless of the current orientation of the trolling motor propeller. FIGS. 4A-4C illustrate views of one example remote device 200. The remote device 200 may include a housing 240 having a first side 243 and a second side 244. In some embodiments, the housing 240 may define a top side 240*a* (see FIG. 4C) and a bottom side 240*b* (see FIG. 4C). The top side 240*a* and bottom side 240*b* may be integral to one another, and, in some embodiments, the top side 240*a* and the bottom side 240*b* may provide a watertight connection. The housing 240 may be made from a plastic material, another easily waterproofable material, and/or a material that may float. The housing 240 may be configured to be easily held in one hand of the user and may be ergonomically configured. The housing 240 may further be configured such that digits of the hand (including the thumb) may engage the different components arranged within the housing 240 without fatigue and/or undue motion. The remote device 200 may be configured so as to be easily be operated by the user's left or right hand. The remote device 200 may be configured to be useable in any orientation, such as a vertical position or a horizontal position. In some embodiments, the remote device 200 may be configured to be mounted, such as to a helm 13 (see FIG. 1) of a watercraft 10 (see FIG. 1). In some embodiments, though the remote device 200 is described as being handheld, it may be permanently (or semi-permanently) mounted and not be held within a hand of a user, as the handheld nature of the remote device 200 is used for an example in the various described embodiments herein.

The remote device 200 may include a joystick 245 attached to the housing 240 between the first side 243 and the second side 244. The joystick 245 may be formed such that a portion of the joystick 245 is external to the housing 240, and a portion of the joystick 245 is in the interior of the housing 240. The joystick 245 may include a rotation member 249 (see FIGS. 4C and 5B) in the interior of the housing 240, surrounded by a collar 248 on the exterior of the housing 240. A stick 247 having a top face 246 may be attached to the rotation member 249, wherein the stick 247 and the top face 246 extend from the rotation member 249 outside of the housing 240. In some embodiments, the rotation member 249 may be formed as a hemisphere and the stick 247 may be attached to a top pole of the hemisphere.

In some embodiments, the joystick 245 may be pivotably supported for movement from a neutral position in directions radial to an axis A1 (see FIG. 4C) of the joystick 245. The neutral position, in the illustrated embodiment, is the position of the joystick 245 when there are no outside forces (e.g., radial pressure; axial pressure) applied, and the stick 247 of the joystick 245 is centered on the axis A1. The joystick 245 may be configured to pivot in all directions (e.g., 360°) about the axis, and may be rotatable between positions. In some embodiments, the movement of the joystick 245 from the neutral position may create one or more commands, such as a steering command. The steering command may be for the trolling motor 117 (see FIG. 2) of the trolling motor assembly 100 to rotate to a heading corresponding to the joystick movement.

In some embodiments, with reference to FIG. 8A, a pressure sensor 253 may be positioned relative to the collar 248 (see FIG. 4C) of the joystick 245 (see FIG. 4A). The pressure sensor 253 may be configured to determine the amount of pressure applied to the collar 248 by movement of the stick 247 (see FIG. 4C). In some embodiments, the pressure sensor 253 may be configured as a potentiometer, such as within the joystick 245. In some embodiments, the detected pressure may create one or more commands, such as indicating a desired thrust (which may be added or separate from the steering command). In some embodiments, the thrust component may be based on a predetermined setting wherein an amount of thrust varies with respect to an amount of pressure applied to the joystick 245. In some embodiments, the thrust component may be disabled.

In some embodiments, with reference to FIG. 4A, the joystick 245 may be configured to include a button. The joystick 245 may be configured such that the top face 246 may be pressed towards the housing 240, thereby depressing the rotation member 249 (see FIG. 4C). The depression of the rotation member 249 may generate a command. In some embodiments, the command may be selectable when the remote device 200 is programed. The command may, for example, be to engage and disengage: an auto pilot, a virtual anchor, a propeller, a user interface, or other commands related to features of the trolling motor assembly 100.

The housing 240 may further include at least one button 255 disposed between the joystick 245 and the second side 244. In some embodiments, the at least one button 255 may be positioned around the joystick 245. In some embodiments, the at least one button 255 may be connected to a processor to thereby engage and/or disengage a feature of the trolling motor assembly 100. In some embodiments, the feature may be the virtual anchor, the propeller, the autopilot, the user interface, and/or an interlock. In some embodiments, the at least one button 255 may be configured to engage and/or disengage a propeller, turn an autopilot on and/or off, or provide input to a user interface. In some embodiments, the remote device 200 may be configured with three buttons 255*a*, 255*b*, and 255*c*. wherein each of the buttons 255*a*, 255*b*, 255*c* may correspond to a different feature of the trolling motor assembly 100. Although three buttons are illustrated, any number of buttons may be used, as this list should not be considered exhaustive, and other features and uses are considered. Further, although the buttons illustrated are tactile buttons, other user inputs are contemplated (e.g., touchscreen icons, touch buttons, dials, sliders, etc.).

In some embodiments, the remote device 200 may further include a display screen 250. In some embodiments, the display screen 250 is positioned in front of the joystick 245 proximate to the first side 243 of the housing 240. The display screen 250 may be configured to present marine data to the user. In some embodiments, the marine data may include the speed of the watercraft 10, the heading of the watercraft 10, current temperature, water temperature, weather forecast, a compass, sonar imagery, or any other marine data.

In some embodiments, the display screen 250 may include a display button 251 integral with and/or adjacent to the display screen 250. In some embodiments, the display button 251 may be configured to turn the display screen 250 on and off, while in other embodiments the display button 251 may be configured to change the marine data presented on the display screen 250. In some embodiments, the display button 251 may be configured to rotate through the marine data displayed, when engaged through a short press, and to turn the screen on and off when the button is held for a predetermined amount of time. In some embodiments, the display button 251 may be a toggle or other user input device capable of scrolling or toggling through menu selections and/or providing similar display selection functionality.

In some embodiments, the remote device 200 may include at least one bottom button 260, as illustrated in FIG. 4B. The bottom button 260 may be positioned between the first side 243 and the second side 244. In some embodiments, the bottom button 260 may be positioned opposite the joystick 245, and in other embodiments, the bottom button 260 may be positioned closer towards one of the first side 243 or the second side 244. In some embodiments, the bottom button 260 and the joystick 245 are positioned within the housing 240 such that a user may rest a thumb on the top face 246 of the joystick 245 while resting another digit (e.g., a pointer finger) on the bottom button 260. In some embodiments, the bottom button 260 may function as an interlock button. To explain, the bottom button 260 may have an engaged position and a disengaged position. The remote device 200 may be configured to generate a steering command when the bottom button 260 is in the engaged position, and the remote device 200 may be configured so that it will not generate a steering command when the bottom button 260 is in the disengaged position. The use of the bottom button 260 as an interlock may prevent undesired rotation and/or movement of the trolling motor housing 115, and thereby the watercraft 10. In some embodiments, one of the at least one buttons 255*a*, 255*b*, 255*c* or the button formed by the joystick 245 may be configured as an interlock, while the bottom button 260 may be configured to correspond to a different feature of the trolling motor assembly 100.

As illustrated in FIG. 4C, the bottom side 240*b* of the housing 240 (see FIG. 4A) may further include a removable cover 259. The removable cover 259 may be configured to provide access to a battery compartment, or to other components within the housing 240 (e.g., processor, transmitter, and/or other computer elements).

In some embodiments, a retention device 257 may be attached to the second side 244 of the housing 240. In some embodiments, the retention device 257 may be a wrist strap, a clip or other attachment device to allow the user to keep the remote device 200 close to a user. In some embodiments, a floatation device may be attached to the remote device 200, such as via the retention device 257.

The remote device 200 may be in wireless communication with the trolling motor assembly 100 (e.g., directly or through other marine electronic device(s)). More specifically, the remote device 200 may transmit the commands generated by the movement and engagement of the components of the remote device 200 to the trolling motor assembly 100 to rotate the trolling motor housing 115 so as to aim in the steer direction, such as to aim the trolling motor housing 115 (e.g., for sonar usage and/or to cause the watercraft 10 (see FIG. 1) to travel in a direction corresponding to the joystick 245 movement). In some embodiments, the remote device 200 may be in wired communication with the trolling motor assembly 100. For example, the remote device 200 may be positioned within the helm 13 (see FIG. 1) of the watercraft 10 and have at least one wire between the trolling motor housing 115 (see FIG. 1) and the helm 13. In some embodiments, when the remote device 200 is within the helm 13, the remote device 200 may be in wireless communication with the trolling motor assembly 100.

The remote device 200 may be calibrated such that the steering commands are generated in relation to the forward facing direction of the watercraft 10 (see FIG. 1). In some embodiments, the forward facing direction may be the direction of the heading of the watercraft 10. The remote device 200 may determine an angle of difference between the direction of movement of the joystick 245 and the forward facing direction. In some embodiments, the angle of difference may be used to determine the steer direction so as to cause the watercraft 10 to travel in the direction corresponding to the joystick 245 movement.

Turning now to FIG. 4D, another example handheld remote device 462 is illustrated. The handheld remote device 462 comprises a joystick 445 that is configured to be rotated to various positions. The joystick 445 may operate similarly to the joystick 245. The handheld remote device 462 also includes various input buttons to enable a user to safely and easily control the operation of a motor. The handheld remote device 462 comprises a first mode selection button 466A and a second mode selection button 466B. Selection of the first mode selection button 466A may cause the handheld remote device 462 to operate in a heading hold mode, and selection of the second mode selection button 466B may cause the handheld remote device 462 to operate in an anchor mode. While two mode selection buttons 466A, 466B are provided in FIG. 4D, only one mode selection button may be provided in some embodiments, and selection of the single mode selection button may cause the mode to toggle between the heading hold mode, the anchor mode, and any additional mode (if any). Three or more mode selection buttons may also be provided in some embodiments, with each button being associated with a particular mode. A processor in the handheld remote device 462 or provided at another location may determine that the one of the mode selection buttons has been activated and may also cause the handheld device to change its mode of operation to the anchor mode or the heading hold mode based on activation of the mode selection button.

In the handheld remote device 462, in some embodiments, the velocity control may be controlled independently from the joystick so that the joystick is not used to control the amount of thrust generated at the trolling motor. A first speed input button 468A and a second speed input button 468B are provided to control the speed, with the first speed input button 468A being configured to cause an increase in the speed when selected and with the second speed input button 468B being configured to cause a decrease in the speed when selected. While two speed input buttons are provided in the embodiment illustrated in FIG. 4D, only one speed input button may be provided in some embodiments. Where only one speed input button is provided, the selection of the speed input button may toggle between different speed settings until the desired speed setting is reached. Alternatively, three or more speed input buttons may be provided, with each of the speed input buttons having a preset speed associated therewith. Where speed input buttons and/or auxiliary input buttons are provided to control the speed, the joystick may be used solely to guide the direction of the watercraft, and this may be beneficial to allow even novice users to easily control the handheld remote device 462. A processor in the handheld remote device 462 or provided at another location may determine that the at least one speed input has been activated and cause the motor to increase or decrease a set value for a thrust component of a steering command based on activation of the at least one speed input. Where two speed input buttons 468A, 468B are provided as illustrated in FIG. 4D, the motor may be caused to increase thrust based on activation of the first speed button 468A or to decrease thrust based on activation of the second speed button 468B.

In some embodiments, holding down the first speed input button 468A or the second speed input button 468B for a threshold period of time may cause the watercraft to shift to a preset speed. For example, holding down the first speed input button 468A for three seconds may cause the speed of the watercraft to be increased to the maximum allowable speed, and holding down the second speed input button 468B for three seconds may cause the speed of the watercraft to be decreased to a minimum speed such as zero.

A first auxiliary input button 464A and a second auxiliary input button 464B are also provided. In some embodiments, the first auxiliary input button 464A may be a heading hold key. Where the first auxiliary input button 464A serves this purpose, the first auxiliary button 464A may be pressed to cause the watercraft to lock into its current course. In some embodiments, the second auxiliary input button 464B may be a menu key. When the second auxiliary input button 464B serves this purpose, the second auxiliary input button 464B may be pressed to cause the watercraft to allow for the adjustment of settings for each mode. For example, a second auxiliary input button 464B serving as a menu button could be selected to enable the adjustment of a jog distance when in the anchor mode and to adjust other settings.

However, in other embodiments, the first auxiliary input button 464A or another button may be configured to increase a jog distance and the second auxiliary input button 464B or another button may be configured to decrease a jog distance. However, in some embodiments, only one auxiliary input button may be provided, and the single auxiliary input button may be pressed to toggle between available settings. Alternatively, three or more auxiliary input buttons may be provided, with each auxiliary input button having a preset setting associated therewith. As a further alternative, no auxiliary input buttons are provided in some embodiments, and the jog distance may be increased or decreased using other buttons. Arrows 470 are indented on the handheld remote device 462. When in heading hold mode, the arrows 470 may be indicative of the current heading direction of the watercraft. In some embodiments, holding down the first auxiliary input button 464A, the second auxiliary input button 464B, or another button for a threshold period of time while operating in the anchor mode may cause the jog distance to shift to a preset speed. For example, holding down the first auxiliary input button 464A for three seconds while operating in the anchor mode may cause the jog distance to be increased to the maximum jog distance, and holding down the second auxiliary input button 464B for three seconds while operating in the anchor mode may cause the jog distance to be decreased to the minimum jog distance.

A display 450 may be provided on the handheld remote device 462 in some embodiments. The display 450 is presenting the current mode in a first area 450A to show that the handheld remote device 462 is operating in an anchor mode. A heading direction is presented in a second area 450B of the display 450, and the current jog distance of five feet is presented in the third area 450C. However, other information such as the current watercraft velocity or other information may be presented in the display 450, the display 450 may have a different size or shape, and a greater amount of information may be presented in the display 450. In some embodiments, the handheld remote device 462 is provided without any display 450.

In an example embodiment, as illustrated in FIGS. 5A-5C, the remote device 200 and trolling motor assembly 100 may be calibrated such that pivoting the joystick 245 towards the first side 243 (see FIG. 4A) of the remote device 200 causes the trolling motor housing 115 to rotate such that the propeller 117*a* (see FIG. 2) is oriented to propel the watercraft 10 in the forward facing direction. FIG. 5A illustrates a split view including a top view of the remote device 200 wherein the joystick 245 is in the neutral position, a side view of the watercraft 10 wherein the propeller 117*a* is oriented in a direction other than the forward facing direction, and a top view of the watercraft 10 illustrating the forward facing direction. As illustrated in FIG. 5A, the watercraft 10 defines a centerline 10*a* extending between the bow and the stem of the watercraft 10. In some embodiments, the forward facing direction along the centerline 10*a* extends past the bow of the watercraft 10. The forward facing direction is independent of the orientation of the trolling motor 117.

FIG. 5B illustrates a similar split view, illustrating the remote device 200 and the watercraft 10 and the trolling motor assembly 100. The joystick 245 of the remote device 200 is pivoted from the neutral position such that the top face 246 is shifted towards the first side 243 of the remote device 200, thereby generating a steering command. The remote device 200 sends a signal 30 to the trolling motor assembly 100 containing the steering command. The trolling motor assembly 100 receives the steering command and rotates the trolling motor 117 such that the propeller 117*a* starts orienting directly to the desired direction to enable propelling the watercraft 10 in the desired direction. FIG. 5B shows a top view and a side view of the beginning orientation of the propeller 117*a* and the direction of rotation. FIG. 5C illustrates another similar split view, illustrating a side view and a top view of the watercraft 10 after the trolling motor assembly 100 executes the steering command and the trolling motor 117 is rotated so as to cause the trolling motor 117 to be oriented in the desired direction (which is the direction the joystick 245 is pointing). This enables the watercraft 10 to travel in the desired direction corresponding to the joystick 245 movement.

In some embodiments, the user may generate the steering command by pivoting the joystick 245 to the desired direction and returning the joystick 245 to the neutral position. The movement may indicate a specific heading such that the trolling motor assembly 100 rotates to the desired direction indicated by the immediate movement of the joystick.

In other embodiments, the user may hold the joystick 245 in the pivoted position until the trolling motor has rotated to the desired direction. In contrast to the conventional device 200' (see FIG. 3A), which allows the trolling motor to rotate until a button is disengaged, here remote device 200 may be configured to rotate the trolling motor assembly 100 to the desired direction and then cease any further rotation, even with the joystick 245 still in the pivoted position. In still other embodiments, the user may generate the steering command with active movement of the joystick 245. The user may pivot the joystick 245 to indicate the desired direction, and as the trolling motor assembly 100 and/or the watercraft 10 rotate to the desired direction, the user may adjust the pivot angle to bring the trolling motor assembly 100 back in line so that the propeller 117*a* of the trolling motor is oriented with the forward facing direction of the watercraft 10.

A user may calibrate the remote device 200, such that when the top face 246 of the joystick 245 is pivoted from the neutral position to a desired direction, the trolling motor 117 rotates to face the desired direction, independent of the starting orientation of the trolling motor 117 and specific to the calibrated direction. For example, the user may wish "backwards" relative to the watercraft to be the generally "forward" direction on the remote device 200. In an example embodiment, illustrated in FIGS. 6A-6C, the trolling motor assembly 100 is configured to rotate the trolling motor 117 to be oriented in the desired direction as indicated by the movement of the joystick 245. FIG. 6A illustrates a split view, including a top view of the remote device 200 wherein the joystick 245 is in the neutral position, and a side view of the watercraft 10 wherein the propeller 117*a* is oriented to indicate that the trolling motor 117 is in the forward facing direction.

FIG. 6B illustrates a similar split view, illustrating the remote device 200, the watercraft 10, and the trolling motor assembly 100. The joystick 245 of the remote device 200 is pivoted from the neutral position such that the top face 246 is in a diagonal direction towards the right side of the first side 243 of the remote device 200 thereby generating a steering command. The remote device 200 may send the signal 30 to the trolling motor assembly 100 containing the steering command. The trolling motor assembly 100 may receive the steering command and rotate the trolling motor 117 such that the propeller 117*a* is oriented and the trolling motor 117 are facing the desired direction, such as to propel the watercraft 10 in the desired direction communicated from the steering command. FIG. 6B illustrates a top view and a side view of the beginning orientation of the propeller 117*a* and the direction of rotation. FIG. 6C illustrates a side view and a top view of the watercraft 10 after the trolling motor assembly 100 executes the steering command and the trolling motor 117 is rotated so as to cause the watercraft 10 to travel in the desired direction corresponding to the joystick 245 movement.

As the steering is correlated to the forward facing direction of the watercraft 10, pivoting the joystick 245 in any direction (e.g., diagonal, left, right, up, down, slightly above left, etc.) will generate a steering command to rotate the trolling motor 117 directly to correspond to the movement of the joystick 245. Further, the trolling motor 117 is not limited to rotating clockwise or counterclockwise, as the steering command is based on the forward facing direction and not rotation direction.

In another example embodiment, illustrated in FIGS. 7A-7C, the trolling motor assembly 100 is configured to rotate the trolling motor housing 115 (see FIG. 2) to the desired direction as indicated by the movement of the joystick 245. FIG. 7A illustrates a split view, including a top view of the remote device 200 wherein the joystick 245 is in the neutral position, and a side view of the watercraft 10 wherein the trolling motor 117 is oriented in a direction other than the forward direction.

FIG. 7B illustrates a similar split view of the remote device 200, the watercraft 10, and the trolling motor assembly 100. The joystick 245 of the remote device 200 is pivoted from the neutral position such that the top face 246 is in a diagonal direction to the right side of the first side 243 of the remote device 200 thereby generating a steering command. The remote device 200 sends the signal 30 containing the steering command to the trolling motor assembly 100. The trolling motor assembly 100 receives the steering command and rotates the trolling motor 117 such that the propeller 117*a* and the trolling motor 117 are facing the desired direction, such as to propel the watercraft 10 in the desired direction communicated from the steering command. Since the steering command may be independent of the starting orientation of the trolling motor 117, the trolling motor assembly 100 may rotate the trolling motor 117 either counterclockwise A2 or clockwise A3 to reach the desired direction depicted so as to cause the watercraft 10 to travel in the desired direction corresponding to the joystick 245 movement.

In some embodiments, the trolling motor assembly 100 may include logic to determine the rotation direction from the current orientation to the desired direction. In some embodiments, a position sensor 1176 (see FIG. 11) on the trolling motor housing 115 (see FIG. 2) may transmit orientation data of the trolling motor 117. The trolling motor assembly 100 may receive the orientation data and determine a path of least rotation between the orientation of the trolling motor 117 and the desired direction of the steering command. Alternatively, in some embodiments, the trolling motor housing 115 may always rotate counterclockwise if the joystick 245 is pivoted to the left of the neutral position and rotate clockwise if the joystick 245 is pivoted to the right of the neutral position. Along similar lines, in some embodiments, the trolling motor housing 115 may always rotate counterclockwise, and in other embodiments the trolling motor housing 115 may always rotate clockwise. In some embodiments, the trolling motor assembly 100 may be configured to rotate the trolling motor housing 115 to the forward facing direction after the watercraft 10 reaches the desired direction, such as to maintain a neutral position for easy rotation. In some embodiments, the trolling motor assembly 100 may maintain the heading of the propeller 117*a* but turn off the motor such that the watercraft 10 moves for example due to the water currents, wind, and/or the shape of the hull of the watercraft 10.

The remote device 200 may be configured to designate a thrust component of the steering command. In some embodiments, the pressure sensor 253 may be positioned relative to the joystick 245, such as integral to the collar 248. The pressure sensor 253 may be configured to detect the amount of pressure applied when the joystick 245 is pivoted from the neutral position. FIG. 8A illustrates a first example, wherein the joystick 245 is pivoted slightly towards the first side 243 (see FIG. 4A) of the remote device 200 indicating a forward facing direction of the trolling motor housing 115. The slight pivot applies a relatively small amount of pressure to the pressure sensor 253 thereby generating a speed component of the steering command. The speed of the trolling motor 117 may vary with the amount of pressure detected by the pressure sensor 253. In an example embodiment, a low pressure may indicate a low speed component (e.g., low speed of travel) as indicated by arrow 197.

FIG. 8B illustrates another example, wherein the joystick 245 is pivoted, such that the stick 247 (see FIG. 4C) is touching the collar 248 (see FIG. 4C) towards the first side 243 (see FIG. 4C) of the remote device 200, indicating a desired direction in the forward direction of the trolling motor housing 115. The large pivot applies a greater amount of pressure to the pressure sensor 253 thereby generating a greater speed component of the steering command, as indicated by arrows 197'.

In some embodiments, a user may set speeds to correspond to varying pressure ranges. For example, a user may set a first pressure range such that pressures in the range only indicate desired rotation component of the trolling motor housing 115 and such that pressures in the range do not indicate any desired speed component; a user may set a second pressure range (e.g., a greater amount of pressure than the first pressure range) such that pressures in the second pressure range indicate a desired rotation component of the trolling motor housing 115 and a first desired speed component (e.g., 2 miles per hour); and a user may set a third pressure range (e.g., a greater amount of pressure than the first and second pressure ranges) such that pressures in the third pressure range indicate a desired rotation component of the trolling motor housing 115 and a second desired speed component (e.g., 4 miles per hour).

The remote device 200 may additionally be configured to engage a virtual anchor feature in the watercraft 10. As discussed above, and with reference to FIG. 9, various buttons of the remote device 200 may be pressed to engage features. As illustrated in FIG. 9, the joystick 245 and/or one of the buttons 255 may be configured to engage the virtual anchor feature. The user may set an offset distance 195, such as from a predetermined list and/or any other selection/input means. As an example, a predetermined list for offset distance 195 options may include 1 foot, 5 feet, 10 feet, 20 feet, etc. One skilled in the art would appreciate that any unit of measurement for distance may be utilized for offset distance 195 (e.g., feet, meters, yards, etc.).

During operation, the watercraft 10 may not remain in a static location. In this regard, the location of the watercraft 10 may be impacted by a variety of factors, such as wind speed, water current, rain, tide conditions, other marine vessels, wildlife, etc. To account for such movement, in some embodiments, the user may engage a virtual anchor feature of the trolling motor assembly 100, such as by pressing the button 255*a* of the remote device 200. The virtual anchor may be configured to instruct the trolling motor assembly 100 to rotate and engage as needed to enable the watercraft 10 to stay within an outer range 196 having the offset distance 195.

Although button 255*a* is used in the present embodiment, any of the buttons 255*a*, 255*b*, or 255*c* may be programmed to engage the virtual anchor feature. Further, in some embodiments, the joystick 245 button is configured to engage the virtual anchor feature. In some embodiments, buttons 260*a*, 260*b* (FIG. 4C), or other buttons on the remote device 200 may be used to engage the virtual anchor feature.

In some embodiments, a remote device may be used to move a watercraft that is in an anchor mode. In some embodiments, activation of the joystick followed by quick release of the joystick may cause a jog movement of the watercraft. FIG. 10A is a schematic view illustrating an example handheld remote device 462 being used to move a watercraft 1010 that is in an anchor mode. A user may press the second mode selection button 466B, and this may cause the handheld remote device 462 to switch to the anchor mode. The watercraft 1010 may initially be positioned at an initial position 1072. The user may make a tapping motion at the joystick 445 of the handheld remote device 462, with the user shifting the joystick 445 in a direction and then quickly releasing the joystick 445 so that the joystick 445 returns back to a neutral position. In the illustrated embodiment, the user makes a tapping motion diagonally towards the top and to the right. In some embodiments, the tapping motion may be performed by pivoting the joystick 445 such that the stick 247 (see FIG. 4C) is touching the collar 248 (see FIG. 4C) and then quickly releasing the joystick 445 so that it returns to a neutral position. However, in other embodiments, the tapping motion may be performed by pivoting the joystick 445 a lesser amount so that the stick 247 does not touch the collar 248 and then quickly releasing the joystick 445 so that it returns to a neutral position.

As a result of the tapping motion generated by the user at the handheld remote device 462, the watercraft 1010 jogs a certain jog distance J to a final anchor position 1078. For example, the watercraft 1010 may jog in increments between 1 foot and 20 feet, and the watercraft 1010 may alternative adjust to jog in increments of 1 foot, 5 feet, 10 feet, 20 feet, etc. One skilled in the art would appreciate that any unit of measurement for distance may be utilized for the jog distance J (e.g., feet, meters, yards, etc.). In some embodiments, a tapping motion where the stick 247 touches the collar 248 may cause a large jog to occur (e.g., 5 feet) and a tapping motion where the stick 247 does not touch the collar 248 may cause a smaller jog to occur (e.g., 1 foot). However, in other embodiments, the jog distance J may be the same regardless of whether or not the stick 247 touches the collar 248 during the tapping motion. The jog distance J may be caused in a jog direction, with the jog direction being dependent on the position of the joystick 445 when shifted from the neutral position. In some embodiments, a jogging movement may not be generated unless the stick 247 comes in contact with the collar 248.

In some embodiments, the jogging movement may be caused by a processor 1165 (see FIG. 11) in the handheld remote device 462 or a processor associated with the handheld remote device 462. The processor 1165 may detect a tapping action at the joystick 445 when the handheld remote device 462 (and/or the trolling motor) is operating in an anchor mode, and the processor 1165 may detect a tapping position of the joystick during the tapping direction, with this tapping position including a tapping direction (e.g., diagonally towards the front and to the right in FIG. 10A). Based on the tapping position, the processor may determine a thrust component and a rotation component, with the thrust component directly or indirectly controlling the thrust generated at a motor and with the rotation component directly or indirectly controlling the rotation component of the motor. The processor may cause rotation of the motor based on the rotation component, and the processor may cause thrust to be generated at the motor based on the thrust component. The processor may cause the watercraft to shift for a jog distance and in a jog direction based on the tapping direction. In some embodiments, where both a thrust component and a rotation component are present, the rotation component may be implemented at a motor before any thrust component is applied.

As illustrated in FIG. 10A, the jogging motion causes the watercraft 1010 to move to a final anchor position 1078. In this final anchor position 1078, the watercraft 1010 may activate the virtual anchor feature so that the motor ceases operation proximate to the final anchor position 1078 and so that the watercraft 1010 rests proximate to the final anchor position 1078. GPS data or other data may be used to determine the final anchor position 1078.

While operating in an anchor mode, other types of movement may be generated at a watercraft. For example, the user may operate a remote control by holding down the joystick 445, and the watercraft may be maintained at a new final anchor position once the joystick 445 is released to a neutral position. FIG. 10B is a schematic view illustrating an example of this.

As illustrated in FIG. 10B, the user may pivot the joystick 445 in a certain direction. The user may change the direction of the joystick 445 as the watercraft moves so that the rotation component that is generated changes over time. For example, in FIG. 10B, the user begins by pivoting the joystick 445 to a first position 445A against the collar 248 that is counterclockwise relative to the forward direction, and the user then alters the position of the joystick 445 over time to a second position 445B so that the joystick 445 is positioned against the collar 248 at a position that is clockwise relative to the forward direction. As a result of these actions at the handheld remote device 462, the watercraft may travel along the path 1076 indicated in FIG. 10B, with the watercraft 1010 initially rotating slightly to the left of the forward direction and with the watercraft 1010 then rotating slightly to the right of the forward direction. In some embodiments, movement of the watercraft 1010 may not be induced unless the joystick 445 is shifted so that the stick 247 (see FIG. 4C) is touching the collar 248 (see FIG. 4C). However, in other embodiments, the tapping motion may be registered by pivoting the joystick 445 a lesser amount so that the stick 247 does not touch the collar 248. In some embodiments, the position of the stick 247 relative to the collar 248 may indicate a thrust component. For example, where the stick 247 is in contact with the collar 248, the thrust component may be maximized, and where the stick 247 is in a non-neutral position but is not in contact with the collar 248, the thrust component may be lower.

Signals may be sent to allow a processor to detect the retention of the joystick in the non-neutral position. The watercraft 1010 may continue travelling as long as the joystick 445 is activated, as is illustrated in FIG. 10B. In some embodiments, the watercraft 1010 may generally continue travelling at the same speed as long as the joystick remains in the non-neutral position, but the speed of the watercraft 1010 may be dependent upon the position of the joystick 445 relative to the collar 248 in other embodiments. Once the user releases the joystick 445, the joystick 445 may return to a neutral position, the motor may cease operation so that it no longer generates thrust proximate to the final anchor position 1078 where the watercraft is located when the joystick 445 is released, and the watercraft 1010 may remain proximate to the final anchor position 1078 as illustrated in the schematic view of FIG. 10C. The final anchor position 1078 may be the location where the watercraft 1010 is positioned when the joystick 445 is released to a neutral position. GPS data or other data may be used to determine the final anchor position 1078. In this final anchor position 1078, the watercraft 1010 may activate the virtual anchor feature so that the motor ceases operation proximate to the final anchor position 1078 and so that the watercraft 1010 remains proximate to the final anchor position 1078.

The remote device may also be used to cause the watercraft to operate in a heading hold mode, and FIG. 10D is a schematic view illustrating the example handheld remote device of FIG. 10A being used to move a watercraft in a heading hold mode. A user may press the first mode selection button 466A, and this may cause the handheld remote device 462 to switch to the heading hold mode. Similar to the anchor mode, a processor within the handheld remote device 462 may determine a thrust component and a rotation component for the travel of a watercraft 1010 when the handheld remote device 462 is being used in the heading hold mode (as with the anchor mode and other modes, additionally or alternatively, such instructions could be determined at the trolling motor and/or a remotely located processor). In the heading hold mode, the thrust component may generally remain the same so that the watercraft generally maintains a constant speed unless the user indicates a desire to change the speed. The thrust component may be adjusted by pressing the first speed input button 468A or the second speed input button 468B.

Steering commands provided to a motor may comprise a thrust component and a rotational component. The thrust component causes the generation of thrust at the trolling motor. In the heading hold mode, the rotational component may be determined based on the position of the joystick 445. The user may pivot the joystick 445 to a desired position, and the motor may be rotated based on the position of the joystick 445. For example, in FIG. 10D, the user has shifted the joystick 445 to a position towards the right of the neutral position. Based on this, a processor 1165 in the handheld remote device 462 may determine a rotational component of motion, and the processor may cause the motor to rotate based on the rotational components so that the watercraft 1010 changes its direction of travel from a first heading direction 1011A to a second heading direction 1011B, with the second heading direction rotated clockwise in the illustrated embodiment.

In some embodiments where the remote device is operating in a heading hold mode, a tapping motion of the joystick 445 may cause rotation of the motor by some set amount. With the tapping motion, the user shifts the joystick 445 and then quickly releases the joystick 445 so that it returns to the neutral position. By tapping the joystick 445 towards the right as indicated in FIG. 10D, the motor may be rotated by various rotational increments (0.1 degrees, 0.5 degrees, 1 degree, 1.5 degrees, 2 degrees, 5 degrees, 10 degrees, etc.). However, the rotational increments may be different in other embodiments. Additionally, the units for rotational increments may be different in other embodiments (e.g., radians or some other unit may be utilized).

In some embodiments, a rotational component may not be generated unless the joystick 445 is shifted so that the stick 247 (see FIG. 4C) is touching the collar 248 (see FIG. 4C). However, in other embodiments, the tapping motion may be performed by pivoting the joystick 445 a lesser amount so that the stick 247 does not touch the collar 248. In some embodiments, the position of the stick 247 relative to the collar 248 may indicate a magnitude of the rotational component. For example, where the stick 247 is in contact with the collar 248, the rotational component may be maximized (e.g. 5 degrees rotation), and where the stick 247 is in an activated position but is not in contact with the collar 248, the rotational component may be lower (e.g. 1 degree rotation). In some embodiments, the magnitude of the rotational component may be dependent upon the rotational position of the joystick 445. For example, where the joystick 445 is rotated to an angular position that is 45 degrees clockwise relative to the forward direction, the rotational component may be less than the rotational component when the joystick 445 is rotated to an angular position that is 90 degrees relative to the forward direction.

In some embodiments, the rotational component may be limited so that the watercraft may not make large changes in its heading direction in a short amount of time. For example, in FIG. 10E, a schematic view is shown illustrating a cone 1080 that indicates the maximum amount of change in the rotational component. The cone 1080 defines an angle θ, which includes the maximum amount of change in the rotational component towards the left and towards the right—thus, the maximum amount of change in the rotational component towards the left would be θ/2 (the same is true for the maximum amount of change in the rotational component towards the right). The rotational component may be determined based on the position of the joystick, a speed of the watercraft, and a direction of the watercraft. For example, where a large watercraft is travelling at a high speed, the rotational component may be limited to smaller values than where a small watercraft is travelling at a lower speed.

In some embodiments where the handheld remote device 462 is being operating in a heading hold mode, the handheld remote device 462 may be configured so that the user may continuously hold the joystick at an activated position, and the position of the joystick may be used to indicate a desired rotational orientation. For example, in FIG. 10E, the joystick 445 (see FIG. 10A) is initially maintained at a first position 445A where the stick 247 (see FIG. 4C) is positioned against the collar 248 (see FIG. 4C), and a processor 1165 (see FIG. 11) associated with the handheld remote device 462 may be configured to determine a rotational component based on the first position 445A and to cause rotation of the motor based on the rotational component. In some embodiments, the processor 1165 may be configured to rotate the motor until the motor is rotated to the rotational orientation indicated by the joystick 445. For example, where the user holds the joystick 445 at an angle that is 45 degrees counterclockwise relative to the forward direction, the processor may cause rotation of the motor incrementally until the motor has been rotated 45 degrees. Once the desired rotational orientation for the motor has been reached, the processor may cease causing rotation of the motor even when the joystick 445 is still being held at an angle that is 45 degrees clockwise relative to the forward direction.

In some embodiments, the angular position of the joystick may indicate a desired rotational velocity or acceleration rather than a desired rotational orientation. For example, in FIG. 10E, the joystick 445 (see FIG. 10A) is initially maintained at a first position 445A, where the joystick 445 is 45 degrees counterclockwise relative to the forward direction. A processor associated with the handheld remote device 462 may be configured to determine a rotational component based on the first position 445A of the joystick 445 and to cause rotation of the motor based on the rotational component. In some embodiments, the processor may be configured to rotate the motor until the motor is rotated to the angle indicated by the joystick 445. For example, where the user holds the joystick 445 at an angle that is 45 degrees counterclockwise relative to the forward direction, the processor may cause rotation of the motor incrementally until the motor has been rotated 45 degrees. Once the desired rotational orientation for the motor has been reached, the processor may cease causing rotation of the motor even when the joystick 445 is still being held at an angle that is 45 degrees to the left of the forward direction.

In some embodiments, the processor may be configured to rotate the motor at a certain rotational speed or rotational acceleration based on the first position 445A. For example, where the user holds the joystick 445 at an angle that is 45 degrees to the left (or counterclockwise) of the forward direction, the processor may cause rotation of the motor at a rotational speed of 2 degrees per second or at a rotational acceleration of 0.5 degrees per second squared. In such an embodiment, the processor would not stop causing rotation of the watercraft when a specific rotational orientation is reached, and the processor would continue in causing rotation at the same rotational speed or acceleration until the joystick shifted to another position or returned to a neutral position. Where the angular position of the joystick indicates a desired rotational velocity or acceleration, a maximum rotational velocity and/or a maximum rotational acceleration may be implemented to prevent sudden changes in the heading direction for safety reasons.

The heading hold mode is different from the anchor mode in that, when the joystick 445 is released and returns to a neutral position, the motor may continue to apply thrust to move the watercraft 1010 in the body of water (e.g., in the new direction). An example of this is illustrated in the schematic view of FIG. 10F. As illustrated in FIG. 10E, the watercraft 1010 moves along the path 1076 based on the commands input by the user. The watercraft 1010 continues along this path 1076 as illustrated in FIG. 10F. Once the joystick 445 is released, the watercraft 1010 may generally continue in the same direction of travel, with the thrust component remaining constant and with the rotational component being reduced to zero.

The user may hold down on the joystick 445 to retain the joystick 445 in a non-neutral position, and the user may shift the joystick 445 from a first non-neutral position to a second non-neutral position to cause changes in the heading direction of the watercraft. The position of the joystick may be determined when the joystick is in a second non-neutral position when the handheld device is operating in the heading hold mode. Additionally, rotation of a motor (e.g., a trolling motor) may be caused based on the position of the joystick when the joystick is in the second non-neutral position, and this rotation may cause the watercraft to travel in a second heading direction when the motor is in the water and the motor is operating.

Example System Architecture

FIG. 11 shows a block diagram of an example motor system 1100 capable for use with several embodiments of the present invention. The motor system 1100 may be a motor system in some embodiments. As shown, the motor system 1100 may include a number of different modules or components, each of which may comprise any device or means embodied in either hardware, software, or a combination of hardware and software configured to perform one or more corresponding functions. For example, the motor system 1100 may include a main housing 1125, a motor housing 1115, and an intermediate controller 1185. In some cases, the motor system 1100 may include a user input device housing 1140.

The motor system 1100 may also include one or more communications modules configured to communicate with one another in any of a number of different manners including, for example, via a network. In this regard, the communication interface (e.g., 1171) may include any of a number of different communication backbones or frameworks including, for example, Ethernet, the NMEA 2000 framework, GPS, cellular, WiFi, or other suitable networks. The network may also support other data sources, including GPS, autopilot, engine data, compass, radar, etc. Numerous other peripheral, remote devices such as one or more wired or wireless multi-function displays may be connected to the motor system 1100.

The main housing 1125 may include processor(s) 1170, a memory 1175, a communication interface 1171, a user interface 1172, a display 1173, one or more sensors (e.g., location sensor 1174, a position sensor 1176, a motor sensor 1181, etc.). Notably, the position sensor 1176 and motor sensor 1181 are shown in the motor housing 1115, although these sensors could be positioned elsewhere (such as in the main housing 1125).

The processor(s) 1170 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 1170 as described herein.

In this regard, the processor(s) 1170 may be configured to analyze electrical signals communicated thereto to provide display data to the display to indicate the direction of the motor housing 1115 relative to the watercraft.

In some embodiments, the processor(s) 1170 may be further configured to implement signal processing or enhancement features to improve the display characteristics or data or images, collect or process additional data, such as time, temperature, GPS information, waypoint designations, or others, or may filter extraneous data to better analyze the collected data. It may further implement notices and alarms, such as those determined or adjusted by a user, to reflect depth, presence of fish, proximity of other watercraft, etc.

The memory 1175 may be configured to store instructions, computer program code, marine data, such as chart data, location/position data, heading data and other data associated with the device in a non-transitory computer readable medium for use, such as by the processor.

The communication interface 1171 may be configured to enable connection to external systems (e.g., an external network 1190). In this manner, the processor(s) 1170 may retrieve stored data from a remote, external server via the external network 1190 in addition to or as an alternative to the memory 1175.

The location sensor 1174 may be configured to determine the current position and/or location of the main housing 1125. For example, the location sensor 1174 may comprise a GPS, bottom contour, inertial navigation system, such as micro electro-mechanical sensor (MEMS), a ring laser gyroscope, or the like, or other location detection system.

The display 1173 may be configured to display images and may include or otherwise be in communication with a user interface 1172 configured to receive input from a user. The display 1173 may be, for example, a conventional LCD (liquid crystal display), an LED display, or the like. The display may be integrated into the main housing 1125. In some example embodiments, additional displays may also be included, such as a touch screen display, mobile device, or any other suitable display known in the art upon which images may be displayed.

In any of the embodiments, the display 1173 may be configured to display an indication of the current direction of the motor housing 1115 relative to the watercraft. Additionally, the display may be configured to display other relevant motor information including, but not limited to, speed data, motor data battery data, current operating mode, auto pilot, or the like.

The user interface 1172 may include, for example, a keyboard, keypad, function keys, mouse, scrolling device, input/output ports, touch screen, or any other mechanism by which a user may interface with the system.

The position sensor 1176 may be found in one or more of the main housing 1125, the motor housing 1115, or remotely. In some embodiments, the position sensor 1176 may be configured to determine a direction of which the motor housing 1115 is facing. In some embodiments, the position sensor 1176 may be operably coupled to either the shaft or steering system 1130, such that the position sensor 1176 measures the rotational change in position of the motor housing 1115 as the motor housing 1115 is turned. The position sensor 1176 may be a magnetic sensor, a magnetometer, an accelerometer, a light sensor, mechanical sensor, or the like.

The motor housing 1115 may include a motor 1117, which may be a trolling motor. The motor housing 1115 may also include one or more other sensors (e.g., motor sensor 1181, position sensor 1176, water temperature, current, etc.), which may each be controlled through the processor(s) 1170 (such as detailed herein).

In some embodiments, the motor system 1100 may include an intermediate controller 1185 that includes a processor 1182, a controller 1183 and a memory 1184. The processor 1182 of the intermediate controller 1185 may receive and analyze electrical signals communicated thereto to provide rotation instructions to a steering mechanism 1189 configured to rotate the motor housing 1115 about the shaft and change the orientation or the motor housing 1115 to steer the watercraft.

In some example embodiments, the motor system 1100 may be in communication with a user input device 1140. The user input device 1140 may include a joystick 1145, and a display 1150, which may be connected to one or more processors 1165. In some embodiments, one or more buttons may be included in the user input device (such as described in various embodiments herein).

The user input device housing 1140 further includes a transmitter 1167, and a memory 1166 coupled with the processor(s) 1165. The joystick 1145 may be pivoted within the user input device housing 1140, and the movement of the joystick 1145 may be received by the processor(s) 1165 and memory 1166 and converted into an electrical signal transmitted by the transmitter 1167. In some embodiments, the signal may be sent from the transmitter 1167 to the communications interface 1171 in the main housing 1125, the controller 1183 of the intermediate controller 1185, the external network 1190, or directly to the controller 1180 of the motor housing 1115.

In some embodiments, the motor system 1100 may include additional sensors, for example, a speed sensor, such as an electromagnetic speed sensor, paddle wheel speed sensor, or the like configured to measure the speed of the watercraft through the water.

In some embodiments, the motor system 1100 may include a motor sensor. The motor sensor may be a voltage sensor, a rotation per minute (RPM) sensor, a current sensor or other suitable sensor to measure the output of the motor 1117.

In some embodiments, the motor system 1100 may include a battery sensor 1191. The battery sensor 1191 may include a current sensor or voltage sensor configured to measure the current charge of a battery power supply of the motor system 1100.

In some embodiments, the motor system 1100 may include a GPS sensor 1191, and GPS data received from the GPS sensor 1191 may be utilized to determine the location of the watercraft.

Example Flowchart(s) and Operations

Some embodiments of the present invention provide methods, apparatus, and computer program products related to controlling a trolling motor according to various embodiments described herein. Various examples of the operations performed in accordance with embodiments of the present invention will now be provided with reference to FIG. 12.

FIG. 12 illustrates a flowchart according to an example method of steering a trolling motor system according to an example embodiment. The operations listed in and described with respect to FIG. 12 may for example be performed with the assistance of and/or under the control of one or more processors 1170, 1165, 1182, controller 1183, 1180, trolling motor systems 1100, memory 1175, 1166, 1184, communication interfaces 1171, 1167, user interface 1172, user input devices, joystick 1145, buttons, displays 1150, 1173, steering mechanisms 1189, location sensor 1174, and/or position sensor 1176.

The method for steering a trolling motor with a remote device depicted in FIG. 12 may optionally include calibrating the trolling motor and device (e.g., user input device) orientation at operation 1210. The device may be calibrated such that when the joystick is moved from the neutral position towards the first side of the device, the trolling motor is rotated so as to face in the forward direction with respect to the watercraft. After calibration, the method 1200 may optionally continue by engaging an interlock button at operation 1220. In some embodiments, an interlock button may be provided to prevent incidental or accidental movements of the joystick being translated into movement of the watercraft. The method 1200 may continue by pivoting the joystick to a desired orientation at operation 1230. The method 1200 may continue by receiving the movement data from the joystick movement at the processor at operation 1240. The method 1200 may continue by generating a steering command at operation 1250. In some embodiments, the steering command correlates to the movement data, wherein the position of the joystick, the speed of the movement, and/or the force applied about the movement may correlate to the desired direction and/or desired thrust of the steering command. The method 1200 may continue by transmitting the steering command to the trolling motor at operation 1260.

FIG. 13 illustrates another flowchart for controlling operation of a motor of a watercraft. The motor may be a trolling motor or some other type of motor. At operation 1302, the mode of the handheld remote device may be determined (this may be in addition to or in the alternative to determining the mode in operation 1316). This may be done by determining whether the remote device and/or motor is being operated in a heading hold mode or in an anchor mode. The mode may be determined by receiving an indication that a mode selection button has been activated, and the handheld device may be caused to operate in the anchor mode or the heading hold mode based on this determination. At operation 1304, movement data is received from the joystick. This movement data is received when the joystick is in a non-neutral position, and the movement data includes a direction of movement from the neutral position. At operation 1306, one or more steering commands are generated. Steering commands may differ based on the current mode. From the generated steering command(s), at least one steering command is based on the movement data. At operation 1308, rotation of the motor is caused. This rotation is caused based on the steering command, and rotation causes the watercraft to travel in a new heading direction when the trolling motor is in the water and when the trolling motor is operating. At operation 1310, movement of the joystick back to the neutral position is detected. The watercraft is at a location when the joystick moves to the neutral position. At operation 1312, an indication such as a signal may be received to indicate that a speed input such as a speed input button has been activated. At operation 1314, an increase or decrease in the thrust component may be caused based on the receipt of the indication at operation 1312.

At operation 1316, a decision is made as to whether the remote device is being operated in a heading hold mode or in an anchor mode (although as noted above, this may be already known). If the remote device is operating in a heading hold mode, then the method 1300 proceeds to operation 1318. If the remote device is operating in an anchor mode, then the method 1300 proceeds to operation 1320. At operation 1318, the motor is caused to continue operating so that the watercraft continues to travel in the new heading direction. At operation 1320, the motor is caused to cease in operation proximate to the location.

FIG. 14 illustrates a flow chart of an example method for causing incremental changes in the position or heading direction of the watercraft based on tapping motions at a joystick, in accordance with some embodiments discussed herein.

At operation 1402, a tapping action is detected at the joystick. At operation 1404, a tapping direction and/or a tapping displacement may be detected. The tapping displacement is the displacement of the joystick from the neutral position. At operation 1406, a mode is determined (although this may already be known or it could have been determined earlier). The mode may be determined by receiving an indication that a mode selection button has been activated, and the handheld device may be caused to operate in the anchor mode or the heading hold mode based on this determination.

At operation 1408, a decision is made as to whether the remote device is being operated in a heading hold mode or in an anchor mode. If the remote device is operating in a heading hold mode, then the method 1400 proceeds to operation 1410. If the remote device is operating in an anchor mode, then the method 1400 proceeds to operation 1416.

At operation 1410, an indication such as a signal may be received to indicate a change in the rotational increment. This may be received based on selection by the user of one or more buttons when the handheld remote device 462 is being operated in the heading hold mode. At operation 1412, an increase or decrease in the rotational increment may be caused based on the receipt of the indication at operation 1410.

At operation 1414, rotation of the motor may be caused in the rotational increment, and this may be caused based on the tapping direction and/or the tapping displacement. In some embodiments, this may be caused solely based on the tapping direction, and the tapping displacement may have no impact on the rotational increment.

Where operating in the anchor mode, the method 1400 proceeds from operation 1408 to operation 1416. At operation 1416, an indication such as a signal may be received to indicate that a jog distance button has been activated. This may be received based on selection by the user of one or more buttons when the handheld remote device 462 is being operated in the anchor mode. At operation 1418, an increase or decrease in the jog distance may be caused based on the receipt of the indication at operation 1416.

At operation 1420, the watercraft may be caused to shift for a jog distance in a jog direction based on the tapping direction and/or the tapping displacement. In some embodiments, this may be caused solely based on the tapping direction, and the tapping displacement may have no impact on the jog distance or the jog direction. The watercraft may be caused to shift based on adjustments made at the motor of the watercraft.

FIGS. 12-14 describe various operations. These operations may generally be performed in any order. For example, different operations in method 1200, method 1300, and method 1400 may be performed in different orders or some of the operations may be performed simultaneously. Additionally, some of the operations included in method 1200, method 1300, and method 1400 may be omitted in some embodiments, and additional operations may also be added to the method 1200, method 1300, and method 1400.

FIGS. 12-14 illustrate a flowchart of a system, method, and computer program product according to an example embodiment. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the various described memory and executed by, for example, the various described processor(s). As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed:

1. A handheld device for controlling operation of a trolling motor of a watercraft, the handheld device comprising:

a housing;

a joystick attached to the housing and pivotably supported for movement from a neutral position in directions radial to an axis of the joystick, wherein the movement from the neutral position generates one or more steering commands for the trolling motor;

a transmitter within the housing;

at least one processor communicatively coupled to the transmitter and the joystick; and a memory including computer program product stored thereon, wherein the computer program product is configured, when executed, to cause the at least one processor to:

determine that the handheld device is operating in an anchor mode or a heading hold mode;

receive movement data from the joystick when the joystick is in a non-neutral position, wherein the movement data includes a direction of movement from the neutral position;

generate the one or more steering commands, wherein at least one steering command of the one or more steering commands is based on the movement data;

cause rotation of the trolling motor based on the steering command to cause the watercraft to travel at a non-zero speed in a new heading direction when the trolling motor is in the water and when the trolling motor is operating;

detect the joystick shifting from the non-neutral position back to the neutral position, wherein the watercraft is at a location when the joystick shifts to the neutral position; and in response thereto:

when the handheld device is operating in the anchor mode, cause the trolling motor to cease operation proximate to the location after the joystick has shifted to the neutral position; or when the handheld device is operating in the heading hold mode, cause the trolling motor to continue operating so that the watercraft continues to travel at the non-zero speed in the new heading direction after the joystick has shifted to the neutral position.

2. The handheld device of claim 1, wherein each of the one or more steering commands have at least one of rotational component or a thrust component, wherein the rotational component of the one or more steering commands causes rotation of the trolling motor, and wherein the thrust component of the one or more steering commands causes the generation of thrust at the trolling motor.

3. The handheld device of claim 2, wherein, when the handheld device is operating in the heading hold mode, the rotational component is determined based on the position of the joystick and the thrust component remains at a set value after the joystick has shifted to the neutral position, and wherein the set value is a non-zero value.

4. The handheld device of claim 2, wherein at least one of the rotational component or the thrust component are limited for safety.

5. The handheld device of claim 2, wherein the rotational component is limited for safety.

6. The handheld device of claim 5, wherein the rotational component is determined based on the position of the joystick, a speed of the watercraft, and a direction of the watercraft.

7. The handheld device of claim 1, wherein the joystick is not used to control the amount of thrust generated at the trolling motor.

8. The handheld device of claim 1, wherein the computer program code is configured to, when executed, cause the at least one processor to:

detect a tapping action at the joystick when the handheld device is operating in an anchor mode;

detect a tapping direction of the joystick during the tapping action; and cause the watercraft to shift for a jog distance and in a jog direction based on the tapping direction.

9. The handheld device of claim 8, wherein the jog distance is between one foot and twenty feet.

10. The handheld device of claim 8, further comprising at least one jog distance button, wherein the computer program code is configured to, when executed, cause the at least one processor to:

determine that the at least one jog distance button has been activated; and cause an increase or a decrease in the jog distance based on activation of the at least one jog distance button.

11. The handheld device of claim 8, wherein the computer program code is configured to, when executed, cause the at least one processor to:

detect the joystick being retained in the non-neutral position when the handheld device is operating in an anchor mode, wherein each of the one or more steering commands have a rotational component and a thrust component, wherein each of the one or more steering commands cause at least one of rotation or thrust at the trolling motor, wherein the thrust component of the steering command is maintained at a set value when the joystick is retained in the non-neutral position, and wherein the set value is a non-zero value.

12. The handheld device of claim 8, wherein the computer program code is configured to, when executed, cause the at least one processor to:

detect the joystick being retained in the non-neutral position when the handheld device is operating in an anchor mode, wherein the thrust component of the steering command is dependent upon a displacement of the joystick from the neutral position when the joystick is in the activated position.

13. The handheld device of claim 1, wherein the computer program code is configured to, when executed, cause the at least one processor to:

determine the position of the joystick when the joystick is in a second non-neutral position when the handheld device is operating in the heading hold mode, wherein the second non-neutral position is different from the non-neutral position; and cause rotation of the trolling motor based on the position of the joystick when the joystick is in the second non-neutral position, wherein rotation of the trolling motor causes the watercraft to travel in a second heading direction when the trolling motor is in the water and the trolling motor is operating.

14. The handheld device of claim 1, further comprising at least one mode selection button, wherein the computer program code is configured to, when executed, cause the at least one processor to:

determine that the at least one mode selection button has been activated; and cause the handheld device to change its mode of operation to the anchor mode or the heading hold mode based on activation of the at least one mode selection button.

15. The handheld device of claim 14, wherein the at least one mode selection button includes an anchor button and a heading hold button, wherein the anchor button is configured to switch to the anchor mode when activated, and wherein the heading hold button is configured to switch to the heading hold mode when activated.

16. The handheld device of claim 1, further comprising at least one speed input, wherein the computer program code is configured to, when executed, cause the at least one processor to:

receive an indication that the at least one speed input has been activated; and cause the trolling motor to increase or decrease a set value for a thrust component of a steering command based on activation of the at least one speed input.

17. The handheld device of claim 16, wherein the at least one speed input includes a first speed button and a second speed button, wherein the first speed button is configured to increase the speed, wherein the second speed button is configured to decrease the speed, and wherein the computer program code is configured to, when executed, cause the at least one processor to:

determine that at least one of the first speed button or the second speed button has been activated;

cause the motor to increase thrust based on activation of the first speed button or to decrease thrust based on activation of the second speed button.

18. A system for controlling the operation a watercraft, the system comprising:

the watercraft;

a housing;

a joystick attached to the housing and pivotably supported for movement from a neutral position in directions radial to an axis of the joystick, wherein the movement from the neutral position generates one or more steering commands for a motor;

a transmitter within the housing;

at least one processor communicatively coupled to the transmitter and the joystick; and a memory including computer program product stored thereon, wherein the computer program product is configured, when executed, to cause the at least one processor to:

determine that the handheld device is operating in an anchor mode or a heading hold mode;

receive movement data from the joystick when the joystick is in a non-neutral position, wherein the movement data includes a direction of movement from the neutral position;

generate the one or more steering commands, wherein at least one steering command of the one or more steering commands is based on the movement data;

cause rotation of the motor based on the steering command to cause the watercraft to travel in a new heading direction when the motor is in the water and when the motor is operating;

detect the joystick shifting from the non-neutral position back to the neutral position, wherein the watercraft is at a location when the joystick shifts to the neutral position;

in response thereto:

when the handheld device is operating in the anchor mode, cause motor to cease operation proximate to the location after the joystick has shifted to the neutral position; or when the handheld device is operating in the heading hold mode, cause the motor to continue operating so that the watercraft continues to travel in the new heading direction after the joystick has shifted to the neutral position;

detect a tapping action at the joystick when the handheld device is operating in the anchor mode;

detect a tapping direction of the joystick during the tapping action;

cause the watercraft to shift for a jog distance and in a jog direction based on the tapping direction;

detect the joystick being retained in the non-neutral position when the handheld device is operating in the anchor mode; and in response thereto, cause a thrust component of the steering command to be maintained at a non-zero value.

19. The system of claim 18, further comprising:

a GPS sensor, wherein the at least one processor is configured to cause a determination of the location using data from the GPS sensor.

20. A method of operating a handheld device for controlling a motor of a watercraft, the method comprising:

determining that the handheld device is operating in an anchor mode or a heading hold mode;

receiving movement data from the joystick when the joystick is in a non-neutral position, wherein the movement data includes a direction of movement from the neutral position;

generating one or more steering commands, wherein at least one steering command of the one or more steering commands is based on the movement data;

causing rotation of the motor based on the steering command to cause the watercraft to travel in a new heading direction at a non-zero thrust value when the motor is in the water and when the motor is operating;

detecting the joystick shifting from the non-neutral position back to the neutral position, wherein the watercraft is at a location when the joystick shifts to the neutral position; and in response thereto:

when the handheld device is operating in the anchor mode, causing the motor to cease operation proximate to the location after the joystick has shifted to the neutral position; or when the handheld device is operating in the heading hold mode, causing the motor to continue operating at the non-zero thrust value so that the watercraft continues to travel in the new heading direction after the joystick has shifted to the neutral position.

21. A handheld device for controlling operation of a trolling motor of a watercraft in an anchor mode, the handheld device comprising:

a housing;

a joystick attached to the housing and pivotably supported for movement from a neutral position in directions radial to an axis of the joystick, wherein the movement from the neutral position generates one or more steering commands for the trolling motor;

a transmitter within the housing;

at least one processor communicatively coupled to the transmitter and the joystick; and a memory including computer program product stored thereon, wherein the computer program product is configured, when executed, to cause the at least one processor to:

determine that the handheld device is operating in the anchor mode;

receive movement data from the joystick when the joystick is in a non-neutral position, wherein the movement data includes a direction of movement from the neutral position;

generate the one or more steering commands, wherein at least one steering command of the one or more steering commands is based on the movement data;

cause the watercraft to move using on the one or more steering commands applied at the trolling motor when the trolling motor is in the water and when the trolling motor is operating;

detect the joystick shifting from the non-neutral position back to the neutral position, wherein the watercraft is at a location when the joystick shifts to the neutral position;

cause, in response thereto, the trolling motor to cease operation proximate to the location after the joystick has shifted to the neutral position;

detect a tapping action at the joystick;

detect a tapping direction of the joystick during the tapping action;

cause the watercraft to shift for a jog distance and in a jog direction based on the tapping direction;

detect the joystick being retained in the non-neutral position after the tapping action; and in response thereto, cause a thrust component of the steering command to be maintained at a non-zero value.

22. A handheld device for controlling operation of a trolling motor of a watercraft in a heading hold mode, the handheld device comprising:

a housing;

a joystick attached to the housing and pivotably supported for movement from a neutral position in directions radial to an axis of the joystick, wherein the movement from the neutral position generates one or more steering commands for the trolling motor;

a transmitter within the housing;

at least one processor communicatively coupled to the transmitter and the joystick; and a memory including computer program product stored thereon, wherein the computer program product is configured, when executed, to cause the at least one processor to:

determine that the handheld device is operating in the heading hold mode;

receive movement data from the joystick when the joystick is in a non-neutral position, wherein the movement data includes a direction of movement from the neutral position;

generate the one or more steering commands, wherein at least one steering command of the one or more steering commands is based on the movement data;

cause rotation of the trolling motor based on the steering command to cause the watercraft to travel at a non-zero speed in a new heading direction when the trolling motor is in the water and when the trolling motor is operating;

detect the joystick shifting from the non-neutral position to the neutral position; and cause, in response thereto, the trolling motor to continue operating so that the watercraft continues to travel at the non-zero speed in the new heading direction after the joystick has shifted to the neutral position.

* * * * *